US007680430B2

(12) United States Patent
Mori et al.

(10) Patent No.: US 7,680,430 B2
(45) Date of Patent: Mar. 16, 2010

(54) DEVELOPING APPARATUS, PROCESS CARTRIDGE, DEVELOPER CARTRIDGE, AND IMAGE FORMING APPARATUS INCLUDING LEAKAGE PREVENTING MEMBER

(75) Inventors: Hiroki Mori, Nagoya (JP); Masahiro Ishii, Nagoya (JP); Mitsuru Horinoe, Chita-gun (JP); Yukiko Nakaya, Kounan (JP); Yuichi Matsushita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 756 days.

(21) Appl. No.: 11/508,962

(22) Filed: Aug. 24, 2006

(65) Prior Publication Data

US 2007/0059031 A1 Mar. 15, 2007

(30) Foreign Application Priority Data

Sep. 13, 2005 (JP) ..... 2005-264850

(51) Int. Cl.
*G03G 15/08* (2006.01)

(52) U.S. Cl. ..... 399/103; 399/102; 399/105

(58) Field of Classification Search ..... 399/102, 399/103, 105

See application file for complete search history.

(56) References Cited

U.S. PATENT DOCUMENTS

| | | | |
|---|---|---|---|
| 6,356,723 | B1 | 3/2002 | Sato et al. |
| 6,496,669 | B2 | 12/2002 | Sato et al. |

FOREIGN PATENT DOCUMENTS

| | | |
|---|---|---|
| JP | 11102118 | 4/1999 |
| JP | 2001134080 | 5/2001 |
| JP | 2001134085 | 5/2001 |
| JP | 2001249539 | 9/2001 |
| JP | 2001356598 | 12/2001 |
| JP | 2002132044 | 5/2002 |

*Primary Examiner*—David M Gray
*Assistant Examiner*—Ryan D Walsh
(74) *Attorney, Agent, or Firm*—Banner & Witcoff, Ltd.

(57) ABSTRACT

A developing agent leakage preventing member is provided that is attached to the developer housing and that has a housing attaching face which contacts with the developer housing, a front side face which opposes the housing attaching face, and two side faces each of which connects to each other end portions of the housing attaching face and the front side face in the longitudinal direction of the opening of the developer housing. At least one of the side faces of the developing agent leakage preventing member is formed as an inclined side face that is inclined in a predetermined direction relative to the housing attaching face when pressed from the front side face side. In a developing apparatus, developing agent (toner) leakage is avoided.

28 Claims, 18 Drawing Sheets

DEVELOPING APPARATUS, PROCESS CARTRIDGE, DEVELOPER CARTRIDGE, AND IMAGE FORMING APPARATUS INCLUDING LEAKAGE PREVENTING MEMBER

CROSS-REFERENCE TO RELATED APPLICATIONS

This Nonprovisional application claims priority under 35 U.S.C. §119(a) on Patent Application No. 2005-264850 filed in Japan on Sep. 13, 2005, the entire contents of which are hereby incorporated by reference.

BACKGROUND OF THE INVENTION

1. Field of the Invention

The present invention relates to a developing apparatus, a process cartridge, and a developer cartridge for performing development using a developing agent composed of charged particulates. Further, the present invention relates to an image forming apparatus provided with any one of them.

2. Description of Related Art

In a developing apparatus that performs development by electrostatically adhering toner serving as a developing agent composed of charged-particulates onto an electrostatic latent image, an unavoidable problem arises that the toner leaks from the developing apparatus. The toner having leaked from the developing apparatus pollutes the inside of an image forming apparatus body employing this developing apparatus. This has caused problems that poor printing occurs and that the hands and the clothes of an operator become dirty at the time of changing the developing apparatus.

In particular, in a developing apparatus of nonmagnetic single component development system in which a thin layer of toner is formed on a developing roller having the function of carrying and conveying toner by a layer thickness control blade so that development is performed by causing the layer to oppose an electrostatic latent image, toner leakage easily occurs from the vicinity of the rotating developing roller.

Thus, in the prior art, a developing agent leakage preventing member described below has been attached to a developing apparatus housing and a layer thickness control blade so that toner has been prevented from leaking from the vicinity of the developing roller. Specifically, for example, in a prior art disclosed in Japanese Patent Application Laid-Open No. 2001-134080, a side seal is attached to both end portions in the longitudinal directions of an opening in a housing of a developing apparatus so that toner is prevented from leaking from both end portions of the developing roller. Further, in the prior art described above, an upper seal is attached to a layer thickness control blade attaching portion in the developing apparatus housing, along the longitudinal direction, while a rib sponge and a rear surface side blade side seal are attached to a surface opposing the layer thickness control blade attaching portion in the layer thickness control blade. According to such configuration in the prior art described above, toner is prevented from leaking from a gap formed above the developing roller between the developing roller and the opening of the housing of the developing apparatus.

Nevertheless, in the prior art described above, side faces of the developing agent leakage preventing member for connecting an attaching face (housing attaching face) that attaches the developing agent leakage preventing member to the housing of the developing apparatus or an attaching face (layer thickness control member opposing face) that attaches the member to the layer thickness control blade to a surface opposing each attaching face is formed in a state orthogonal to the attaching face. Thus, when the developing agent leakage preventing member is pressed from the above by the developing roller or the layer thickness control blade, depending on the assembling state of the developing roller or the layer thickness control blade or alternatively the attaching state of the developing agent leakage preventing member, the direction becomes indefinite in which the side faces of the developing agent leakage preventing member is inclined and compressed. As a result, depending on the attaching accuracy of the developing agent leakage preventing member, problems can arise that a gap is generated in a portion in a member which should intrinsically oppose and contact closely with the developing agent leakage preventing member and that a passage for the developing agent is blocked. This causes leakage of the developing agent.

BRIEF SUMMARY OF THE INVENTION

The present invention has been devised in order to solve the problems described above. An object of the present invention is to provide a developing apparatus, a process cartridge, a developer cartridge, and an image forming apparatus in which occurrence of developing agent leakage can be avoided.

In order to achieve this object, the developing apparatus according to a first aspect of the present invention is characterized by comprising: a developer housing having an opening and accommodating a developing agent; a developing agent carrying body arranged in the opening of the developer housing rotatably in such a manner that a rotation axis should agree with a longitudinal direction of the opening, and that develops an electrostatic latent image into a visible image by making a layer of the developing agent formed thereon oppose an electrostatic latent image; and a first leakage preventing member, for preventing developing agent from leakage from both side portions of the developing agent carrying body, attached to the developer housing, and having: a housing attaching face that contacts with the developer housing; a front side face that opposes the housing attaching face; and side faces each of which connects to each other end portions of the housing attaching face and the front side face in the longitudinal directions of the opening of the developer housing; wherein at least one of the side faces is formed as an inclined side face that is inclined in a predetermined direction relative to the housing attaching face when pressed from the side of the front side face.

The process cartridge according to a second aspect of the present invention is a process cartridge formed in a manner attachable to and detachable from an image forming apparatus and is characterized by comprising a carrying body for the electrostatic latent image and a developing apparatus according to the above-mentioned aspect.

The developer cartridge according to a third aspect of the present invention is characterized in that the developing apparatus according to the first aspect is formed in a manner attachable to and detachable from an image forming apparatus or a process cartridge.

The image forming apparatus according to a fourth aspect of the present invention is characterized by comprising the developing apparatus according to the first aspect.

The above and further objects and features of the invention will more fully be apparent from the following detailed description with accompanying drawings.

DETAILED DESCRIPTION OF THE PRESENT INVENTION

Embodiments of the present invention are described below with reference to the drawings.

First, general outlines of an image forming apparatus according to an embodiment of the present invention are described below.

[General Outlines of Image Forming Apparatus]

Figure 1:
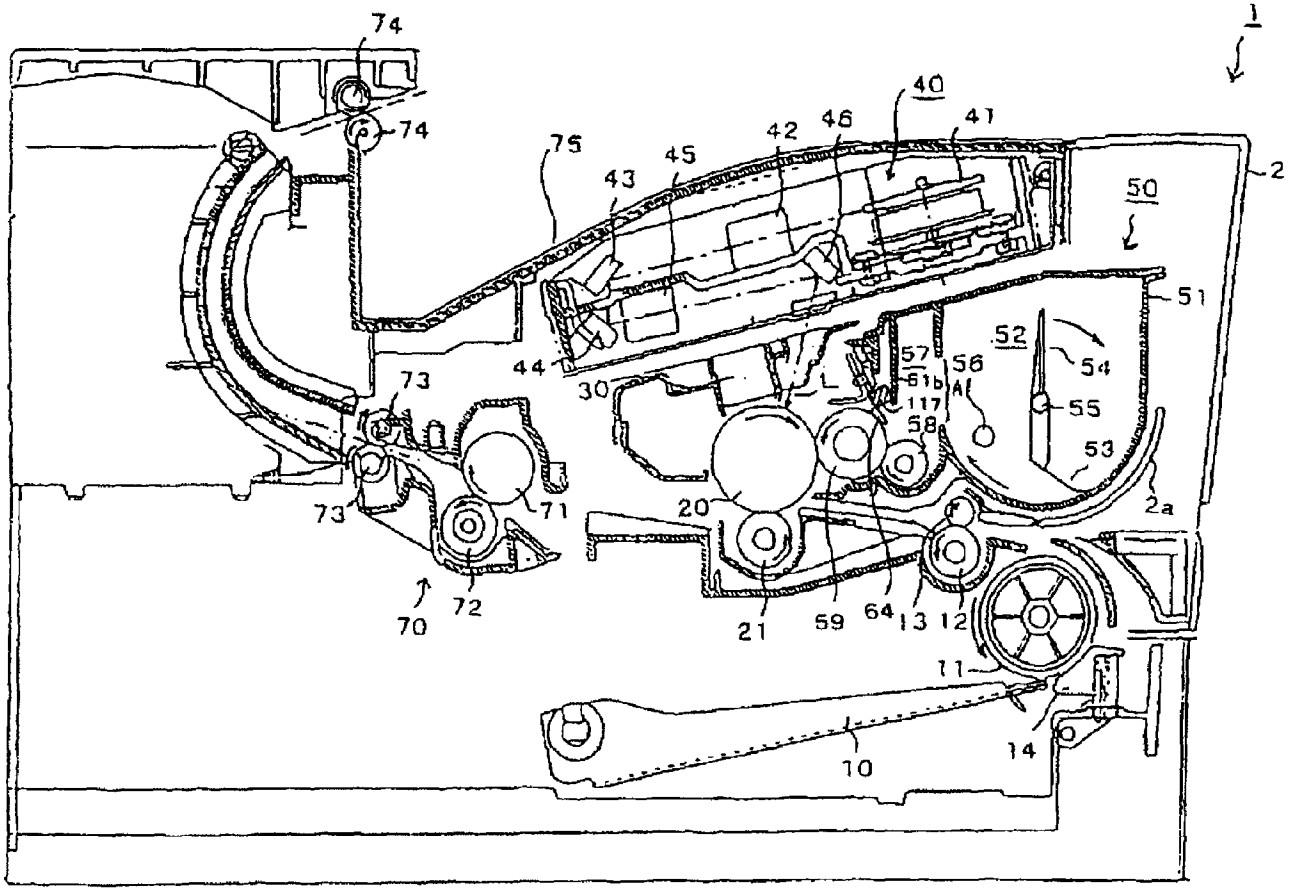
FIG. 1 is a vertical sectional view showing a schematic configuration of an image forming apparatus according to an embodiment of the present invention.

FIG. 1 is a vertical sectional view showing a schematic configuration of a laser beam printer 1 as an embodiment of the image forming apparatus of the present invention. In FIG. 1, in the laser beam printer 1, a feeder unit (not shown) for feeding a printing paper is provided in a bottom portion of a body case 2. The feeder unit is provided with: a paper pressing plate 10 pressed by a spring (not shown); a paper feed roller 11; and a friction separation member 14. The feeder unit presses the papers against the paper feed roller 11 by means of the paper pressing plate 10, then separates the uppermost paper between the paper feed roller 11 and the friction separation member 14 in association with revolution of the paper feed roller 11, and thereby feeds the paper at a predetermined timing.

In the downstream side of the paper conveyance direction in association with the revolution of the paper feed roller 11 that rotates in an arrow direction in FIG. 1, a pair of resist rollers 12 and 13 are supported rotatably. The pair of the resist rollers 12 and 13 convey at a predetermined timing the paper to a transfer position formed by a photosensitive drum 20 and a transfer roller 21 described later.

The photosensitive drum 20 is constructed from a material of positive charging property such as an organic photosensitive material composed mainly of polycarbonate of positive charging property. Specifically, the photosensitive drum 20 is constructed, for example, from a hollow drum in which the main body is fabricated from a cylindrical sleeve made of aluminum and in which a photo electroconductive layer having a predetermined thickness (for example, approximately 20 μm) fabricated by distributing photo electroconductive polymers into polycarbonate is formed in the outer periphery. The cylindrical sleeve is supported by the body case 2 in a freely rotatable manner and in a state connected to the ground potential. Further, the photosensitive drum 20 is driven and rotated in an arrow direction by driving means (not shown).

An electrostatic charger 30 is constructed, for example, from an electrostatic charger of scorotron type for positive electrostatic charging in which corona discharge is generated from an electrostatic charging wire composed of tungsten or the like.

A laser scanner unit 40 includes: a laser generator (not shown) that generates laser light L for forming an electrostatic latent image on the photosensitive drum 20; a polygon mirror 41 that is driven and rotated; a pair of lenses 42 and 45; and reflective mirrors 43, 44 and 46.

A toner accommodating chamber 52 as a developing agent chamber is formed in the inside of a case 51 as a developer housing of a developing apparatus 50. In the inside of the toner accommodating chamber 52, an agitator 53 and a cleaning member 54 are attached to a rotating shaft 55 in a freely rotatable manner. Here, the toner accommodating chamber 52 accommodates toner as a nonmagnetic single component developing agent of positive charging property having electric insulation property. Further, a light translucent window 56 for detecting the amount of remaining toner is provided in each side wall located at each end portion of the rotating shaft 55 in the toner accommodating chamber 52. Further, on the photosensitive drum 20 side in the toner accommodating chamber 52, a development chamber 57 for performing development is formed in a state communicating with the toner accommodating chamber 52 via an opening A. In the inside of the development chamber 57, a feed roller 58 and a developing roller 59 which is a developing agent carrying body are supported rotatably. Toner on the developing roller 59 is controlled into a predetermined layer thickness by a layer thickness control blade 64 which is a layer thickness control member in the form of a thin elastic plate, and then supplied for development.

The developing roller 59 which is a developing agent carrying body is constructed in such a manner that a metal core bar formed from stainless steel or the like is covered by a cylindrical base material formed from an electrically conductive silicone rubber containing carbon particulates having electrical conductivity. Further, on this base material a coating layer is formed that is composed of resin or rubber material containing fluorine. Here, the base material of the developing roller 59 is not limited to electrically conductive silicone rubber, and may be electrically conductive urethane rubber.

Figure 9A:
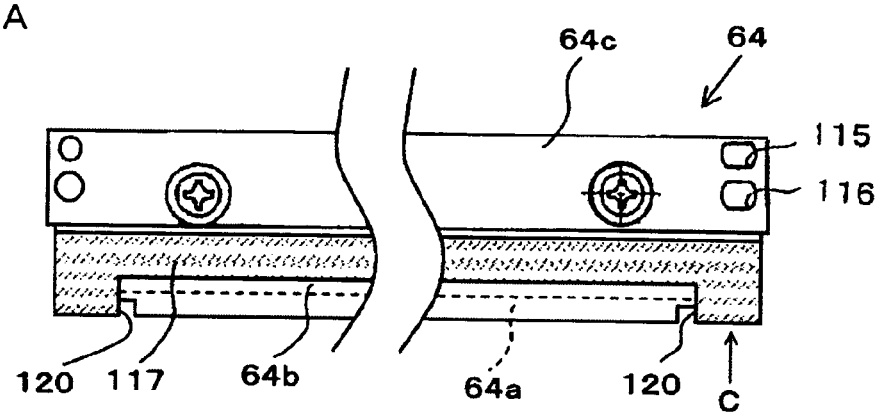
FIG. 9A is an elevation view showing a layer thickness control blade to which a blade back side seal is attached, viewed from the back side.
Figure 9B:
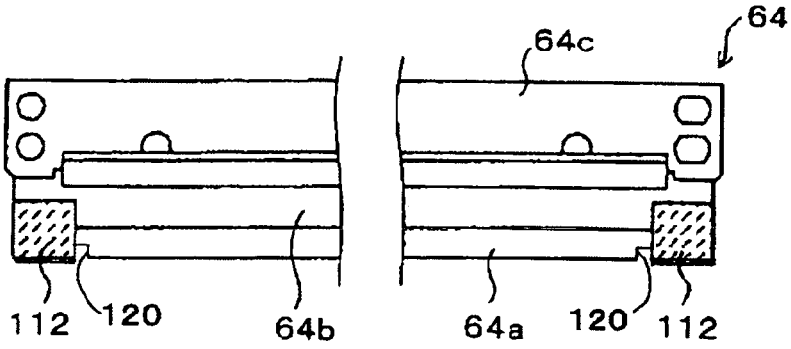
FIG. 9B is an elevation view showing a layer thickness control blade viewed from the front side.

Further, as shown in FIG. 9A and FIG. 9B, the layer thickness control blade 64 is constructed in such a manner that a thin plate-shaped flat spring 64*b* formed from phosphor bronze, stainless steel, or the like is attached to a supporting member 64*c* formed from iron, stainless steel, or the like. Further, on the flat spring 64*b*, a pressing member 64*a* formed from silicone rubber is attached. Further, in the flat spring 64*b*, a cut-out portion 120 cut out in a concave shape is formed near the both end portions, respectively. In correspondence to this, the pressing member 64*a* formed from silicone rubber is formed also into the shape in which the same width is cut out. Here, FIG. 9B is a diagram viewed from an arrow A direction, that is, from the front side in FIG. 10. FIG. 9A is a diagram viewed from the back side which is the opposite side.

Figure 10:
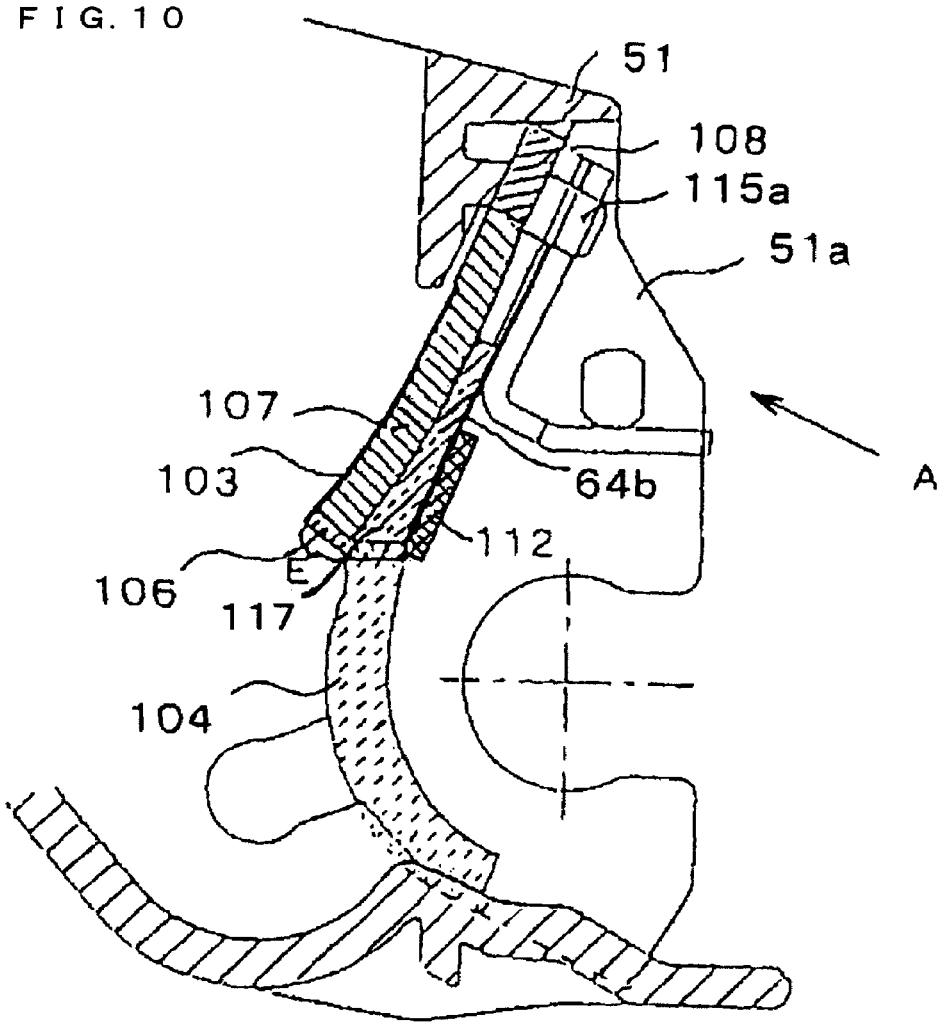
FIG. 10 is a vertical sectional view showing the seal portion in the state; of FIG. 7 viewed from an arrow E direction after a layer thickness control blade is attached.

The supporting member 64*c* is attached to the case 51 by a method that boss holes 115 shown in FIG. 9A are fit over bosses 115*a* on the case 51 side shown in FIG. 10 while screws are fixed through a threaded holes 116 shown in FIG. 9A, respectively. After that, when the developing roller 59 is fixed to the case 51, the pressing member 64*a* is pressed against and contacts with the periphery surface of the developing roller 59 by means of an elastic force of the flat spring 64*b* and an elastic force of the silicone rubber itself. By virtue of this, the toner layer thickness on the developing roller 59 is controlled into a desired value.

Further, the toner accommodated in the above-mentioned toner accommodating chamber 52 is a nonmagnetic single component developing agent of positive charging property. More specifically, the toner is fabricated by a method that silica is added as an external additive to the surface of toner mother particles having a particle size of 5 μm through 15 μm and a volume average particle diameter of 10 μm formed spherically by a suspension polymerization method performed in a state that a well-known coloring agent such as carbon black and a charge controlling agent such as migraine, triphenylmethane, and quarternary ammonium salt are added to mixed monomers of styrene and acrylic.

The transfer roller 21 is constructed from a foaming elastic body composed of silicone rubber or urethane rubber having electrical conductivity, and is supported in a freely rotatable manner. The transfer roller 21 is constructed such as to transfer the toner image on the photosensitive drum 20 reliably onto the paper when a voltage is applied.

The fixing unit 70 is provided in the far downstream side of the conveyance direction for the paper which extends from the resist rollers 12 and 13 to a pressure contact portion between the photosensitive drum 20 and the transfer roller 21, and is provided with a heating roller 71 and a pressing roller 72. The toner image having been transferred onto the paper is heated and pressed during the conveyance by the heating roller 71 and the pressing roller 72, and thereby fixed onto the paper.

A pair of conveying rollers 73 for paper conveyance and a pair of paper discharge rollers 74 are provided in the downstream side of the conveyance direction relative to the fixing unit 70. A paper discharge tray 75 is provided in the downstream side of the paper discharging rollers 74.

Here, the photosensitive drum 20, the transfer roller 21, the electrostatic charger 30, and the developing apparatus 50 described above are accommodated in a process cartridge 2*a*. The process cartridge 2*a* is provided in a manner attachable to and detachable from the laser beam printer 1. Further, the developing apparatus 50 is in the form of a developer cartridge, and is provided in a manner attachable to and detachable from the process cartridge 2*a*.

The image forming operation of the laser beam printer 1 of the present embodiment is as follows. When laser light L modulated in accordance with image information from the laser scanner unit 40 is projected onto the surface of the photosensitive drum 20 uniformly charged by the electrostatic charger 30, an electrostatic latent image is formed on the surface of the photosensitive drum 20. This electrostatic latent image is developed with toner into a visible image by the developing apparatus 50. The visible toner image formed on the photosensitive drum 20 is conveyed to the transfer position by the photosensitive drum 20. At the transfer position, a paper is supplied by the paper feed roller 11 and the resist rollers 12 and 13. Then, the visible toner image formed on the photosensitive drum 20 is transferred onto the paper by a transfer bias applied by the transfer roller 21. Here, the toner remaining on the photosensitive drum 20 after the visible toner image has been transferred is recovered to the development chamber 57 by the developing roller 59.

After that, the paper is conveyed in a state pinched by the heating roller 71 and the pressing roller 72 of the fixing unit 70. At that time, the visible toner image on the paper is fixed onto the paper when the toner is pressurized and heated. Then, the paper is discharged into the paper discharge tray 75 in the upper portion of the laser beam printer 1 by a pair of the conveying rollers 73 and a pair of the paper discharging rollers 74, so that the image forming operation is completed.

[Seal Structure in Developing Apparatus]

Next, a seal structure employing a developing agent leakage preventing member in the developing apparatus 50 of the present embodiment is described below together with an attaching procedure of each member with reference to FIG. 2 through FIG. 18.

Figure 7:
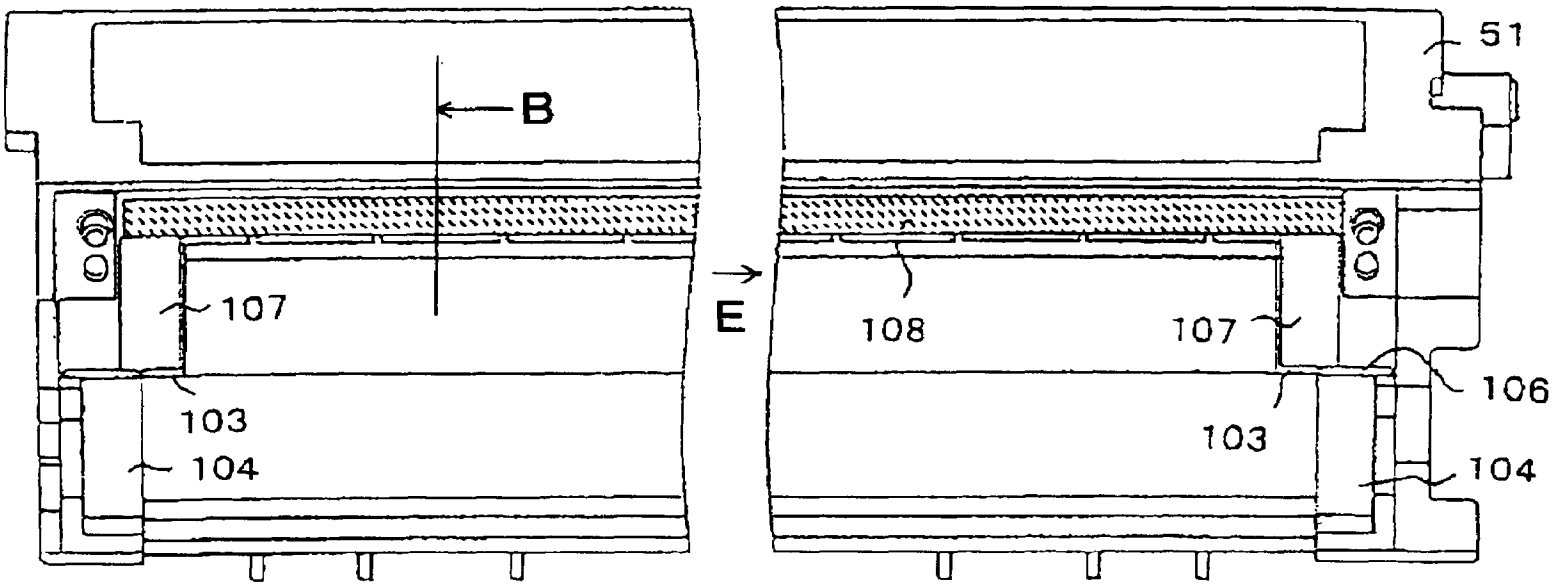
FIG. 7 is an elevation view showing a seal portion of a developing apparatus case in a case that an upper seal is attached.
Figure 8:
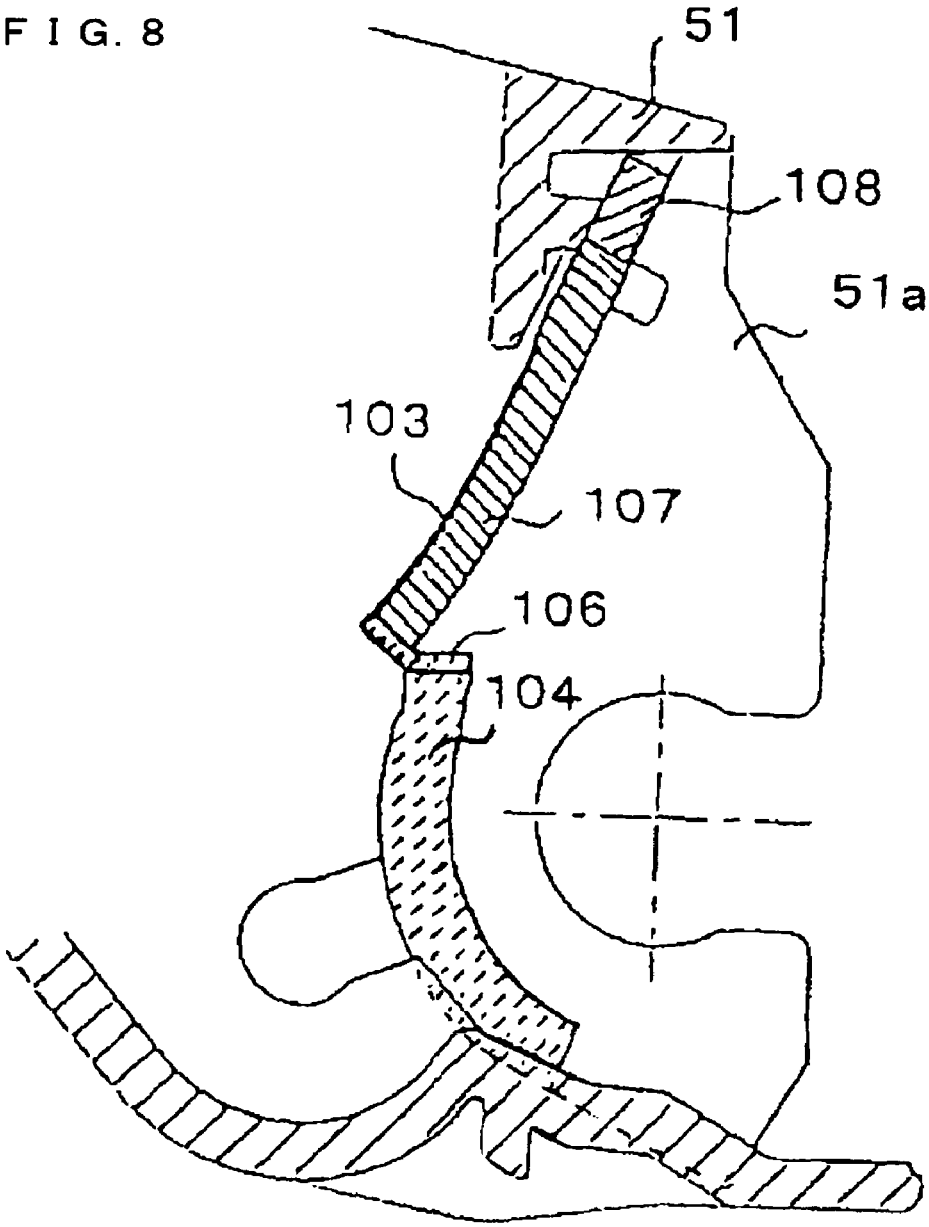
FIG. 8 is a vertical sectional view showing the seal portion in the state of FIG. 7 viewed from an arrow E direction.
Figure 14:
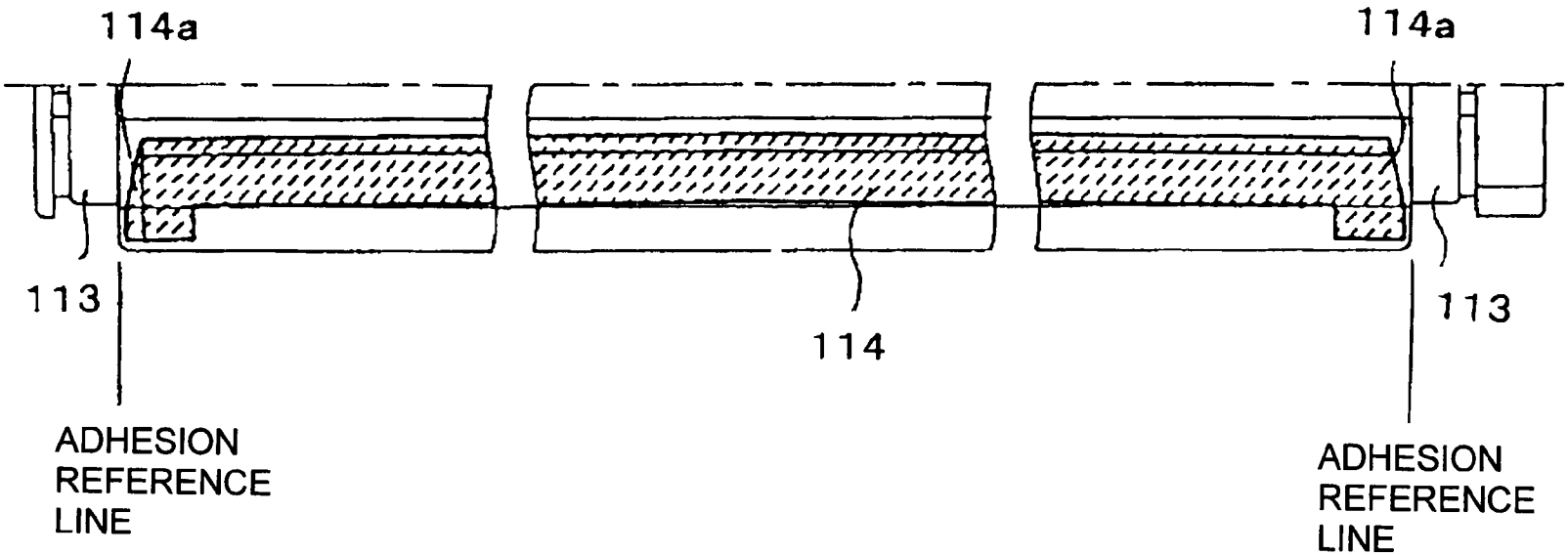
FIG. 14 is a plan view showing a lower film and the vicinity of an attaching portion thereof.
Figure 16:
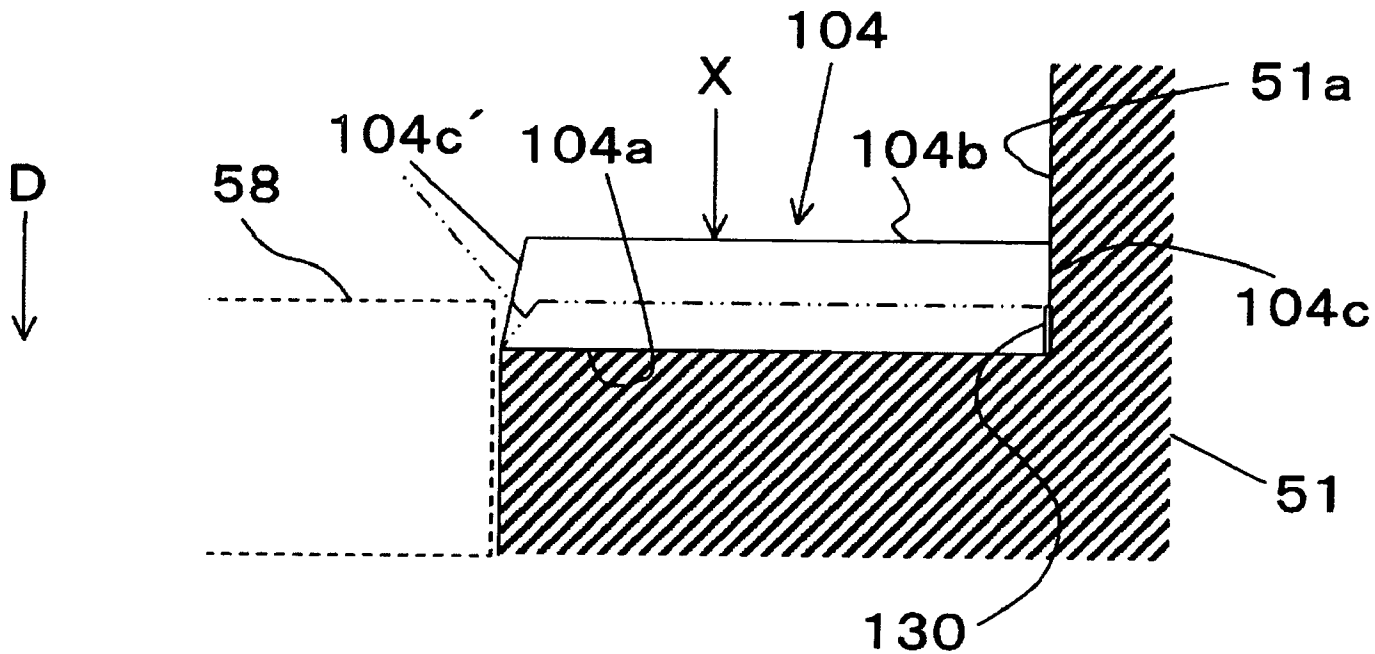
FIG. 16 is a sectional view showing the state of FIG. 4B viewed from an arrow A direction.
Figure 17:
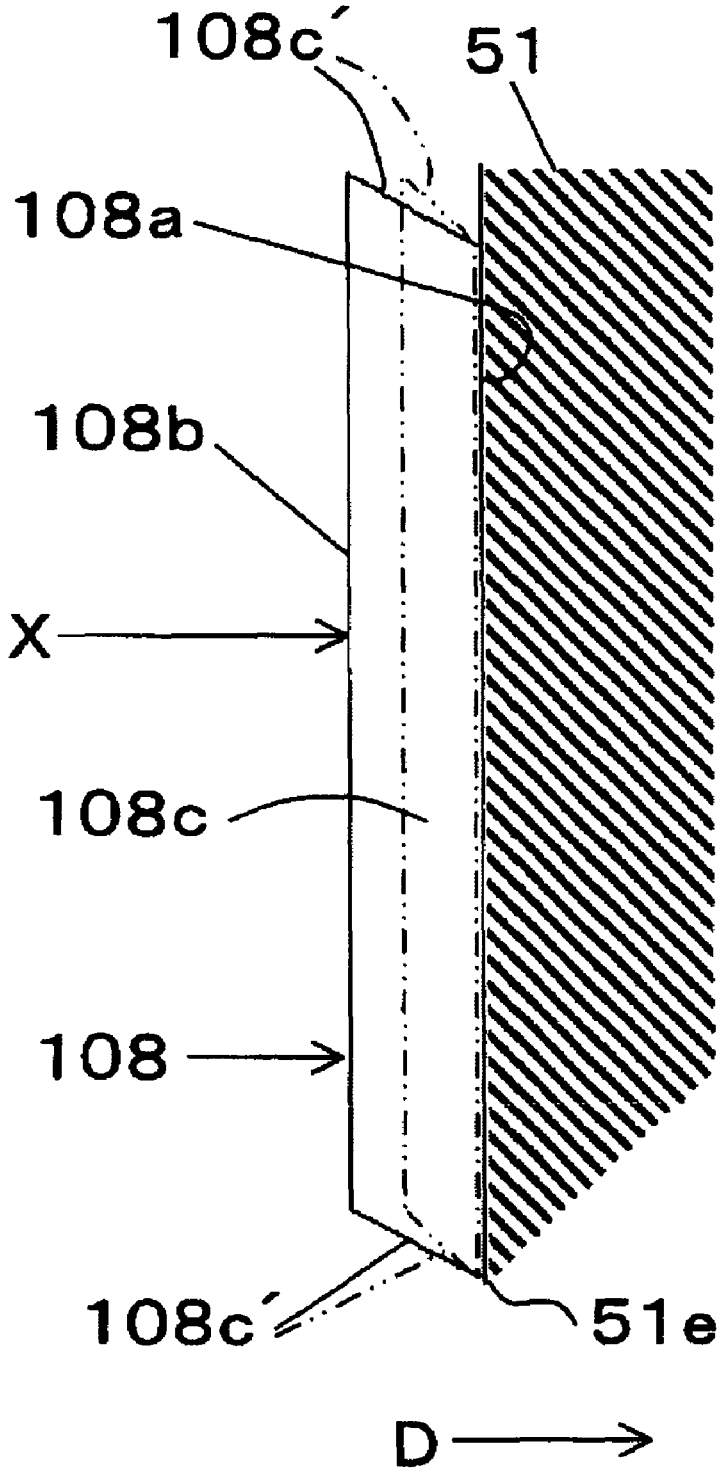
FIG. 17 is a sectional view showing the state of FIG. 7 viewed from an arrow B direction.
Figure 18:
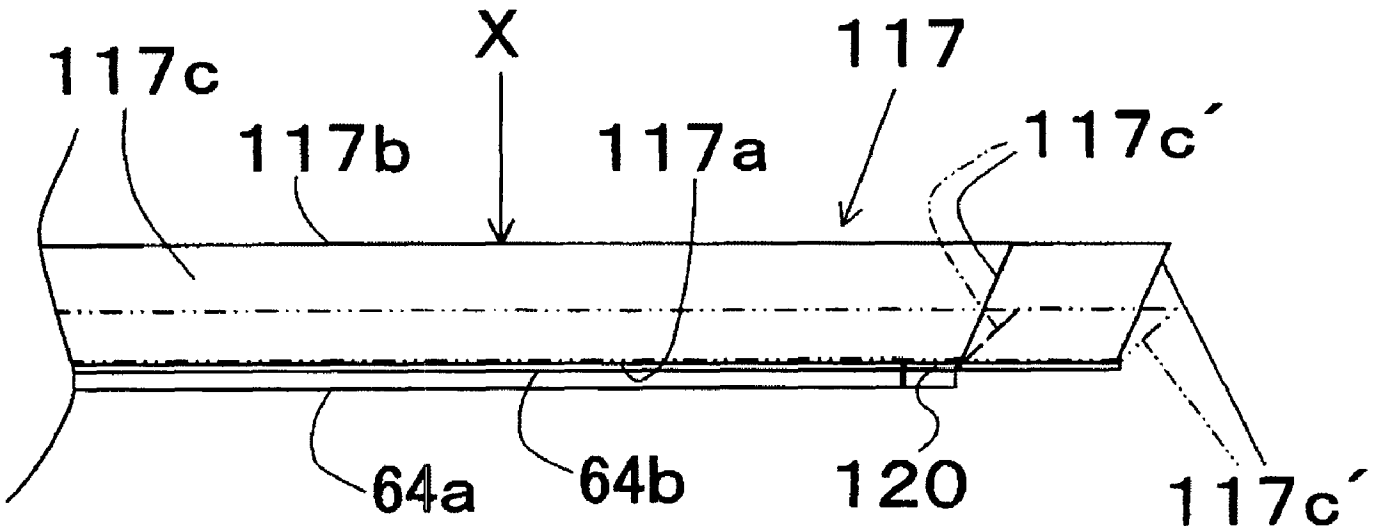
FIG. 18 is an enlarged sectional view showing the seal portion in the state of FIG. 9A viewed from an arrow C direction.

FIG. 2A, FIG. 3A, FIG. 4A, FIG. 5A, FIG. 6A, FIG. 11A, FIG. 12A and FIG. 15 are partly sectional perspective views showing a seal portion of the case 51 in the developing apparatus 50. FIG. 2B, FIG. 3B, FIG. 4B, FIG. 5B, FIG. 6B, FIG. 11B and FIG. 12B are vertical sectional views showing the seal portion in the state shown in the above-mentioned partly sectional perspective views viewed from an arrow B direction, respectively. FIG. 8 is a vertical sectional view showing the seal portion in the state of FIG. 7 viewed from an arrow E direction. FIG. 10 is a vertical sectional view showing the seal portion in the state of FIG. 7 viewed from an arrow E direction after the layer thickness control blade 64 is attached. Further, FIG. 3C is an elevation view showing the seal portion in the state of FIG. 3A viewed from an arrow A direction. FIG. 6C is an elevation view showing the seal portion in the state of FIG. 6A viewed from an arrow A direction. FIG. 7 is an elevation view showing the seal portion of the case 51 in a state that an upper seal is attached. FIG. 9A is an elevation view showing the layer thickness control blade 64 viewed from the back side. FIG. 9B is an elevation view showing the layer thickness control blade 64 viewed from the front side. FIG. 12C is an elevation view showing the seal portion in the state of FIG. 12A viewed from an arrow A direction. FIG. 12D is a sectional view taken along line D-D in FIG. 12B. FIG. 14 is a plan view showing a lower film and the vicinity of an attaching portion thereof. FIG. 16 is a sectional view showing the state of FIG. 4B viewed from an arrow A direction. FIG. 17 is a sectional view showing the state of FIG. 7 viewed from an arrow B direction. FIG. 18 is an enlarged sectional view showing the seal portion in the state of FIG. 9A viewed from an arrow C direction.

Figure 2A:
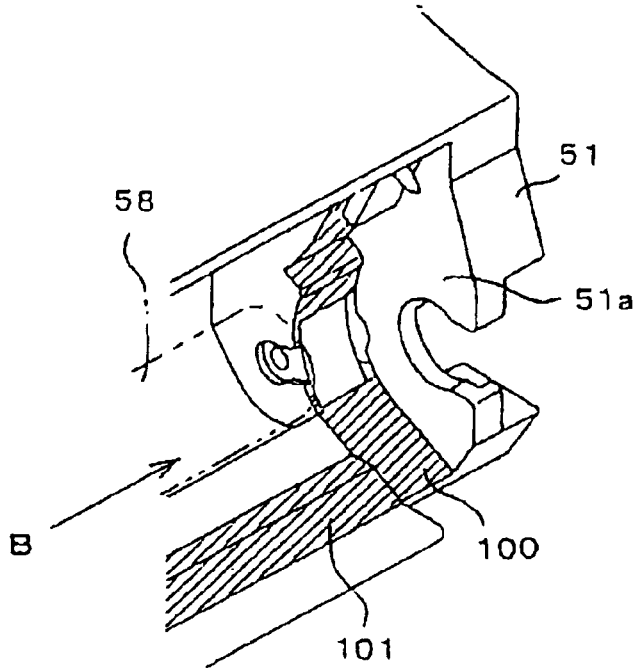
FIG. 2A is a partly sectional perspective view showing a seal portion of a developing apparatus case before a seal member is attached.
Figure 2B:
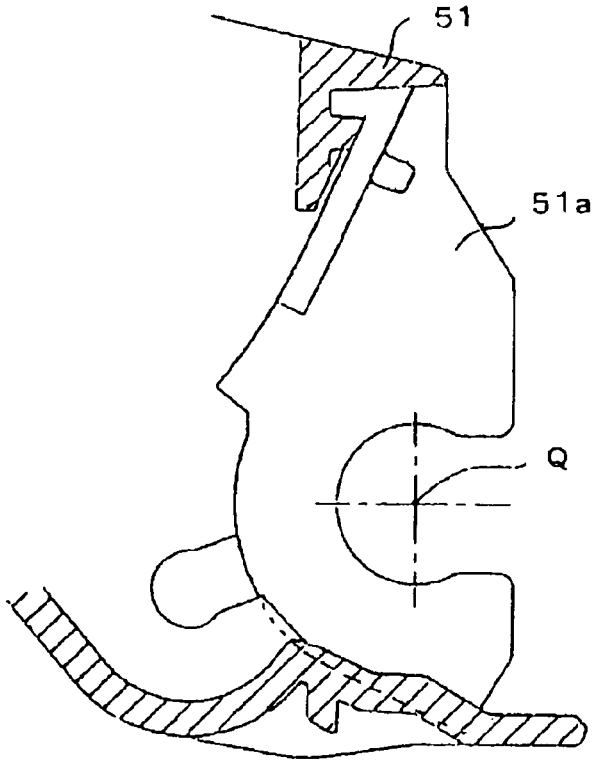
FIG. 2B is a vertical sectional view showing the seal portion in the state of FIG. 2A viewed from an arrow B direction.

In FIG. 2A, each shaded region indicates a region to which a sealing member described below is attached with a double-sided tape. Specifically, these regions consist of a side seal attaching region 100 along the circumferential direction of the developing roller 59 and a lower portion seal attaching region 101 along the longitudinal direction of the developing roller 59 at a lower position of the developing roller 59. Preferably, the side seal attaching region 100 and the lower portion seal attaching region 101 are processed by degreasing treatment in advance in order that the adhesive property of the double-sided tape should be improved.

Here, each end face portion of the developing roller 59 is arranged such as to be close to each side face portion 51*a* of a developing roller accommodating portion of the case 51 shown in FIG. 2A. Point Q shown in FIG. 2B indicates the position of the rotation center axis of the developing roller 59. Further, as indicated by a double-dotted dashed line in FIG. 2A, the feed roller 58 is attached to a feed roller accommodating portion provided in the vicinity of the rear side of the developing roller accommodating portion.

Figure 3A:
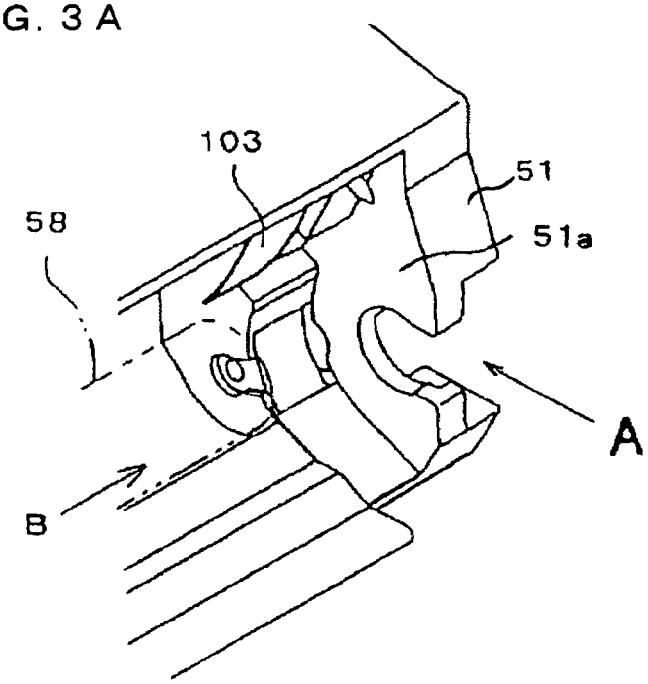
FIG. 3A is a partly sectional perspective view showing a seal portion of a developing apparatus case in a case that an upper portion side seal attaching film is attached.
Figure 3C:
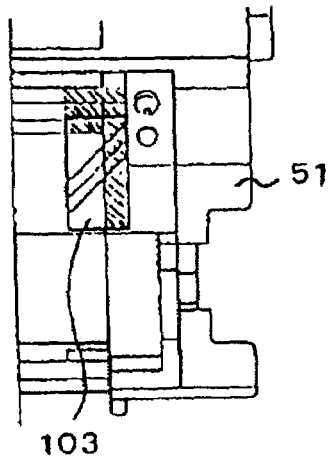
FIG. 3C is an elevation view showing the seal portion in the state of FIG. 3A viewed from an arrow A direction.
Figure 3B:
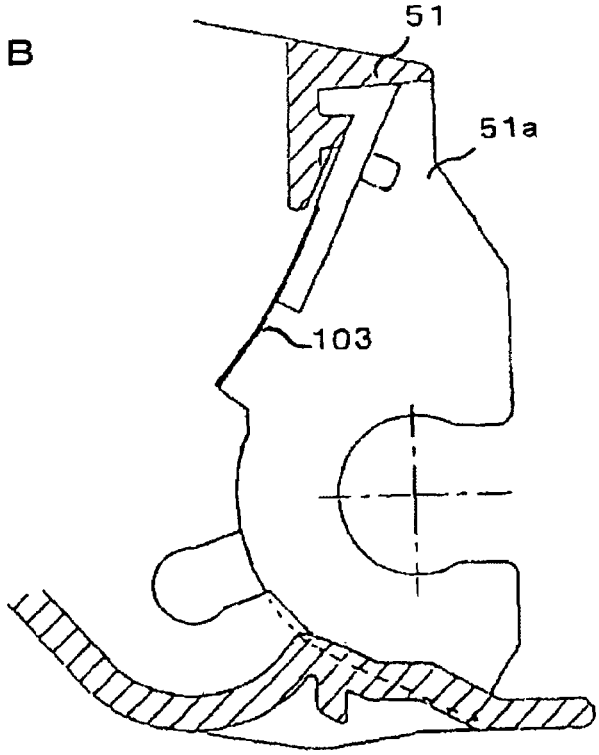
FIG. 3B is a vertical sectional view showing the seal portion in the state of FIG. 3A viewed from an arrow B direction.

Next, as shown in FIG. 3A, FIG. 3B and FIG. 3C, a film 103 for attaching an upper portion side seal is adhered to the case 51 with a double-sided tape. In the layer thickness control blade 64 which is the layer thickness control member attached to the upper position of the developing roller 59, a blade back side seal 117 described later extends to both end portions of the layer thickness control blade 64. On the case 51 side, a later-described upper portion side seal 107 for improving the close contacting property with the blade back side seal 117 is attached. The upper portion side seal 107 is attached in a state overlaid on the film 103 shown in FIG. 3C. Here, when the film 103 is not attached, the adhesion region of the case 51 for the upper portion side seal 107 is solely the shaded region shown in FIG. 3C. This causes poor stability. Thus, in the present embodiment, the film 103 composed of PET is attached to the case 51 so that the adhesion region for the upper portion side seal 107 is ensured.

Figure 4A:
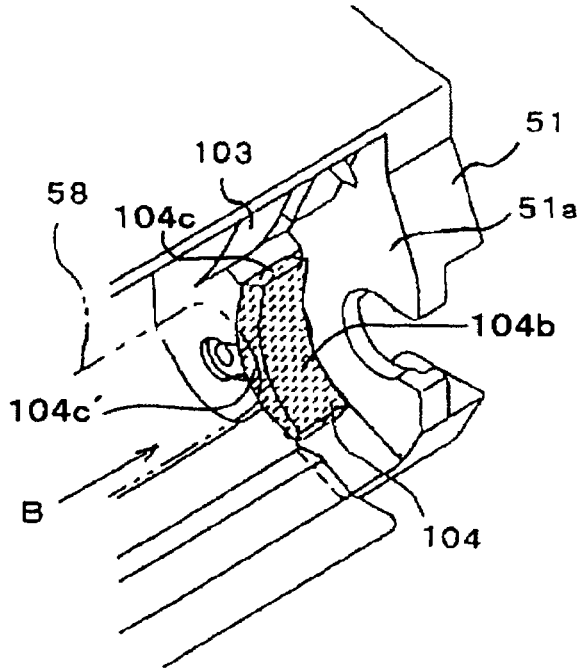
FIG. 4A is a partly sectional perspective view showing a seal portion of a developing apparatus case in a case that a side seal is attached.
Figure 4B:
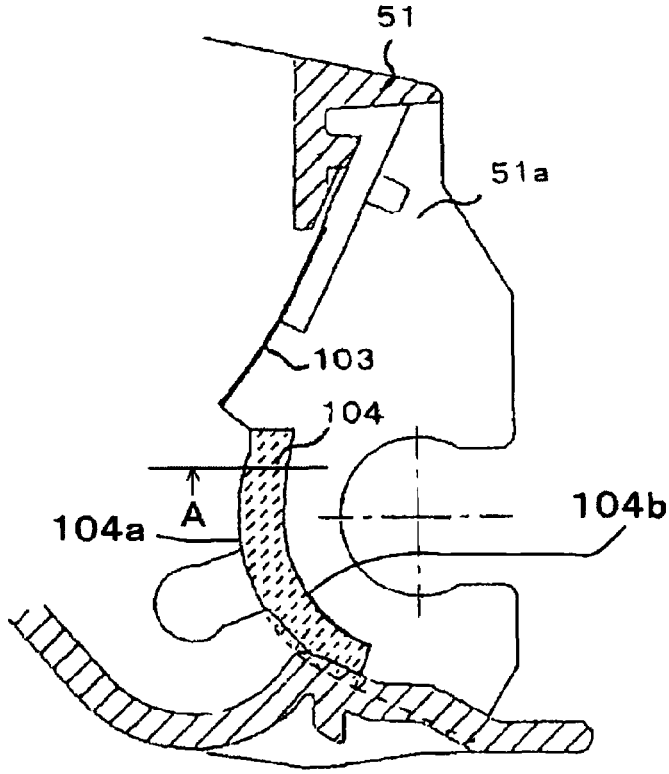
FIG. 4B is a vertical sectional view showing the seal portion in the state of FIG. 4A viewed from an arrow B direction.

Next, as shown in FIG. 4A and FIG. 4B, in order to prevent the toner from leaking from both end portions of the developing roller 59, a side seal 104 which is a first leakage preventing member is attached to each side seal attaching region 100 with a double-sided tape. The side seal 104 is formed from urethane sponge (for example, PORON®) fabricated by ROGERS INOAC Co. ltd.) having relatively high rigidity among materials called sponges. Further, the side seal 104 has a non-negligible thickness in order to generate a predetermined pressing force when compressed by attaching the developing roller 59. Onto the side seal 104, felt 113 of fluorine family described later is attached. Such felt 113 attached onto the side seal 104 is pressed against the developing roller 59 with a predetermined pressing force generated by the pressing force of the side seal 104.

The side seals 104 described above has: a housing attaching face 104*a* attached to the side seal attaching region 100 of the case 51 with a double-sided tape; a front side face 104*b* which is a surface (a surface on the opposite side) opposing the housing attaching face 104*a* and to which the felt 113 is attached; and side faces 104*c* each of which connects to each other the housing attaching face 104*a* and the front side face 104*b* in the opposing relation.

FIG. 16 is a sectional view showing the state of FIG. 4B viewed from an arrow A direction. The side face 104*c* facing an opening D (the feed roller 58 is accommodated in this opening D in FIG. 16) of the case 51 among the side faces 104*c* of the side seal 104 is formed such as to be inclined toward an end portion side in the longitudinal direction of the opening D directing from the housing attaching face 104*a* to the front side face 104*b*. This side face is referred to as the inclined side face 104*c*', hereinafter. Thus, after the felt 113 described later is attached onto the side seal 104, when the developing roller 59 is assembled, the side seal 104 is pressed from the X-direction by the developing roller 59, and thereby compressed into a state indicated by a double-dotted dashed line in FIG. 16. On the other hand, when the inclined side face 104*c*' has the opposite inclination direction, that is, when the inclined side face 104*c*' is formed such as to be inclined inward in the longitudinal direction of the opening D directing from the housing attaching face 104*a* to the front side face 104*b*, the side seal 104 is compressed and falls down toward a side end portion of the feed roller 58. In this state, the compressed inclined side face 104*c*' is pinched between the developing roller 59 and the feed roller 58 so that the later-described felt 113 attached on the side seal 104 contacts with the feed roller 58. In this state, the toner carried on the feed roller 58 contacts with the felt 113 and thereby enters into the inside. Once the toner enters into the felt 113, further toner enters into the felt 113 in such a manner that the toner is attracted. As a result, a portion of toner having entered is adhered to the periphery surface of the developing roller 59, and thereby spreads out. Then, finally, a problem arises that the toner leaks from the edge portions of the developing roller 59. In order to avoid this problem, as described above, the inclined side face 104*c*' of the side seal 104 in the present embodiment is formed such as to be inclined toward an end portion in the longitudinal direction of the opening D directing from the housing attaching face 104*a* to the front side face 104*b*.

Here, in the side seal 104, as shown in FIG. 16, the side face 104*c* opposing the inclined side face 104*c*' may be attached to the side face portion 51*a* in the developing roller accommodation portion of the case 51 with a double-sided tape 130 which is a double-sided adhesion member. In this configuration, since the side face 104*c* is adhered onto the side face portion 51*a*, even when the side seal 104 is pressed and compressed from the X-direction by the developing roller 59, the side face 104*c* is not compressed or deformed such as to fall down. This effectively avoids that a gap causing toner leakage is formed in the vicinity of the side face 104*c* to which the double-sided tape 130 is attached. That is, as shown in FIG. 16, in the side seal 104, when the cross section formed by a plane that passes through the housing attaching face 104*a*, the front side face 104*b*, the inclined side face 104*c*', and the side face 104*c* opposing the inclined side face 104*c*' and that is orthogonal to the housing attaching face 104*a* is formed into a trapezoid while the side face 104*c* opposing the inclined side face 104*c*' is attached to the side face portion 51*a* in the developing roller accommodation portion of the case 51 with a double-sided tape 130, it is avoided that the side seal 104 is compressed into a shape causing toner leakage even when pressed from the X-direction by the developing roller 59. As a result, toner leakage from each end portion of the opening D of the case 51 is avoided effectively by the side seal 104.

Here, the shape of the cross section of the side seal 104 is not limited to a trapezoid. That is, a polygon other than a rectangle may be employed.

Figure 5A:
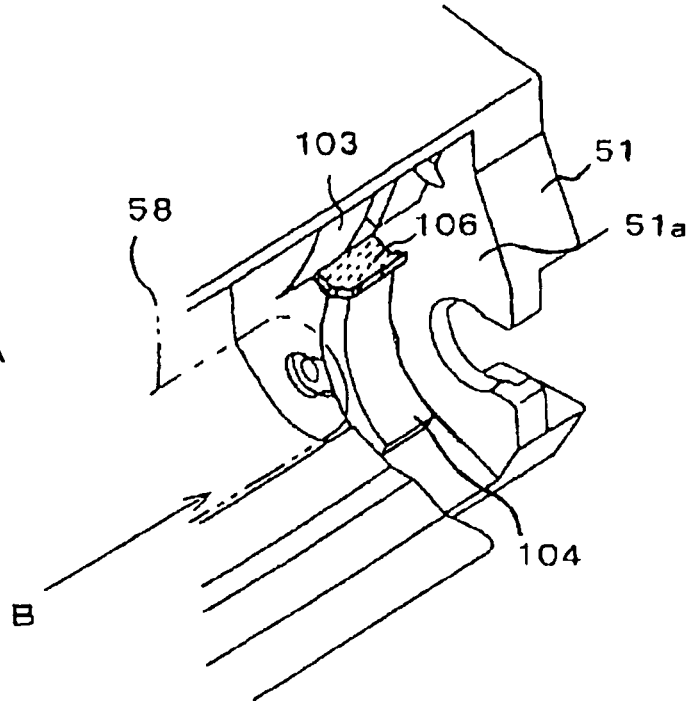
FIG. 5A is a partly sectional perspective view showing a seal portion of a developing apparatus case in a case that an edge seal is attached.
Figure 5B:
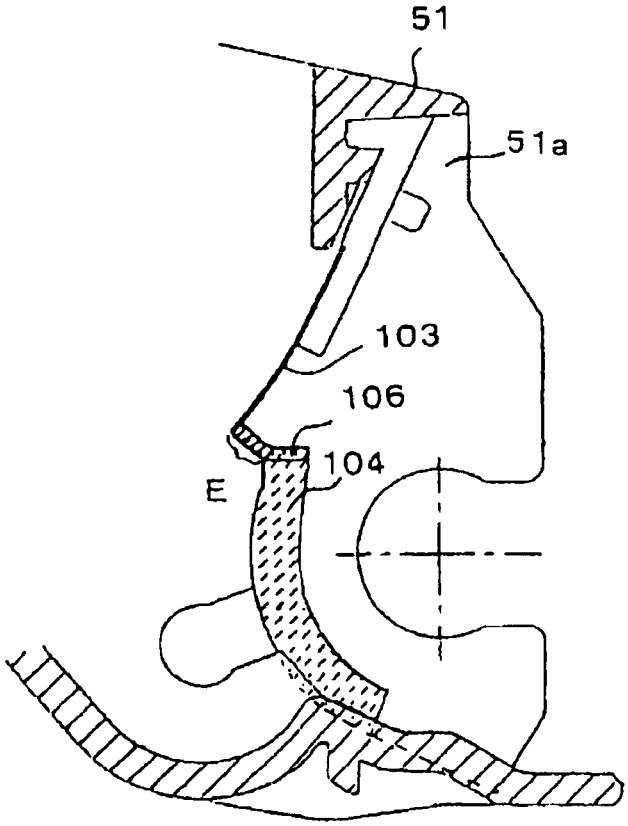
FIG. 5B is a vertical sectional view showing the seal portion in the state of FIG. 5A viewed from an arrow B direction.

Next, as shown in FIG. 5A and FIG. 5B, an edge seal 106 is attached over a region extending from a step portion E formed between the adhesion surface of the side seal 104 of the case 51 and the adhesion surface of the film 103 to the upper end surface of the side seal 104. The edge seal 106 is formed from urethane sponge. When a double-sided tape is adhered onto the bottom face, the edge seal 106 is adhered in such a manner that the above-mentioned step portion E and the upper end surface of the side seal 104 should be connected to each other. By virtue of the edge seal 106 provided as described here, the lower end surfaces without a double-sided tape in the upper portion side seal 107 attached to the film 103 and the blade back side seal 117 attached to the layer thickness control blade 64 can contact with the edge seal 106. As a result, a contacting portion formed between the sponge materials is formed so that toner leakage is avoided reliably.

Figure 6A:
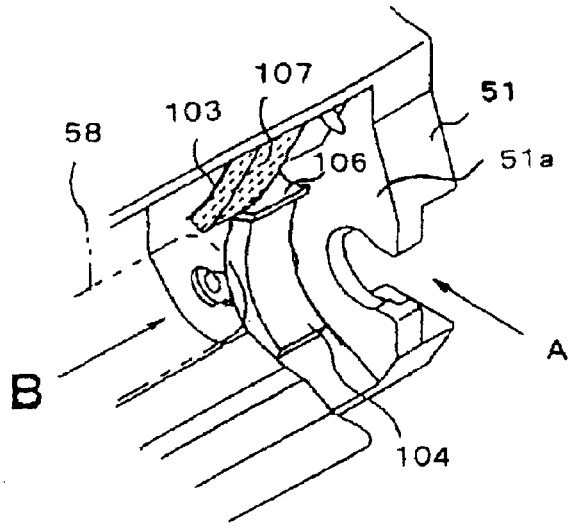
FIG. 6A is a partly sectional perspective view showing a seal portion of a developing apparatus case in a case that an upper portion side seal is attached.
Figure 6C:
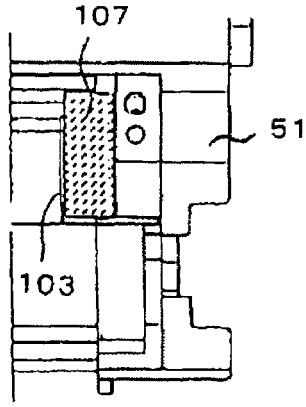
FIG. 6C is an elevation view showing the seal portion in the state of FIG. 6A viewed from an arrow B direction.
Figure 6B:
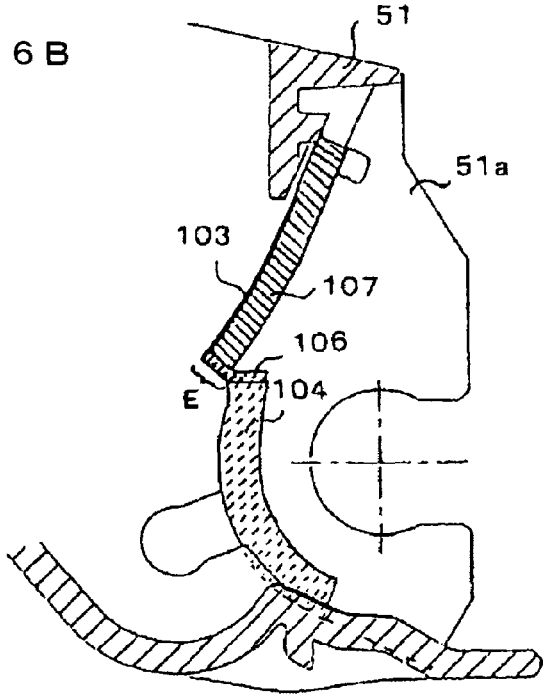
FIG. 6B is a vertical sectional view showing the seal portion in the state of FIG. 6A viewed from an arrow A direction.

Next, as shown in FIG. 6A, FIG. 6B and FIG. 6C, in order to improve the close contacting property with an end portion region of the blade back side seal 117 described later, an upper portion side seal 107 is attached to the film 103 and the case 51 with a double-sided tape. The upper portion side seal 107 is formed from urethane sponge, and is provided at a position in contact with the end portion region of the blade back side seal 117 described later. In this configuration, the contacting portion between the upper portion side seal 107 and the end portion region of the blade back side seal 117 is formed by contact between sponge materials. This reliably avoids toner leakage.

Next, as shown in FIG. 7 and FIG. 8, in order to avoid toner leakage from the upper position on the back side of the attaching portion of the layer thickness control blade 64, an upper seal 108 formed such as to extend in the longitudinal direction of the layer thickness control blade 64 is attached. The upper seal 108 is formed from urethane sponge. The upper seal 108 reliably avoids toner leakage caused by toner flying in a spray form in the toner accommodating chamber 52 and toner leakage occurring when the developing apparatus 50 is turned upside down.

FIG. 17 is a sectional view showing the state of FIG. 7 viewed from an arrow B direction. As shown in FIG. 17, the upper seal 108 has: a housing attaching face 108*a* attached to the upper portion in the longitudinal direction of the opening D of the case 51 with a double-sided tape; a front side face 108*b* which opposes the housing attaching face 108*a* and to which the layer thickness control blade 64 is attached; and side faces 108*c* each of which connects to each other the housing attaching face 108*a* and the front side face 108*b* in the opposite relation. Then, a side face 108*c* that faces the opening D of the case 51 and located on the lower side in FIG. 17 among the side faces 108*c* of the upper seal 108 is formed such as to be inclined in the direction departing from the opening D directing from the housing attaching face 108*a* to the front side face 108*b*. This side face is referred to as the inclined side face 108*c*', hereinafter. Thus, when the layer thickness control blade 64 is assembled onto the upper seal 108, the upper seal 108 is pressed from the X-direction and thereby compressed into a state indicated by a double-dotted dashed line in FIG. 17.

On the other hand, when the inclined side face 108*c*' is formed in the opposite manner, that is, such as to be inclined toward the opening D, the upper seal 108 is compressed into a state that the inclined side face 108*c*' overhangs from the upper end edge 51*e* of the opening D. In this state, toner can adhere to the overhang portion of the inclined side face 108*c*' so that toner leakage can be caused by the stagnation of toner. In order to avoid this possibility, as shown in FIG. 17, the inclined side face 108*c*' of the upper seal 108 that faces the opening D of the case 51 is formed such as to be inclined in a direction departing from the opening D directing from the housing attaching face 108*a* to the front side face 108*b*.

As such, in the upper seal 108, when the cross section formed by a plane that passes through the housing attaching face 108*a*, the front side face 108*b*, the inclined side face 108*c*', and the side face 108*c* opposing this inclined side face 108*c*' and that is orthogonal to the housing attaching face 108*a* is formed into a parallelogram, the upper seal 108 is compressed stably and uniformly in the same direction when pressed from the above. Obviously, the side face opposing the inclined side face 108*c*' need not be formed in parallel to the inclined side face 108*c*', and may be orthogonal to the housing attaching face 108*a*. Alternatively, a polygon other than a rectangle may be employed in such a manner that the shape of the cross section described above becomes a trapezoid.

Next, as shown in FIG. 9A, a blade back side seal 117 which is a second leakage preventing member for preventing the toner from leakage between the case 51 and the layer thickness control blade 64 is attached with a double-sided tape to the flat spring 64*b*, that is, the back side of the layer thickness control blade 64 attached to the supporting member 64*c* of the layer thickness control blade 64. When the layer thickness control blade 64 is attached to the case 51, the flat spring 64*b* receives a pressing force from the upper portion side seal 107 and the blade back side seal 117 as shown in FIG. 12D. However, since the blade back side seal 117 has a width that presses not only the flat spring 64*b* but also end portions of the pressing member 64*a*, the flat spring 64*b* is not bent. This avoids toner leakage caused by the bending of the flat spring 64*b*. Further, although a double-sided tape is adhered to an adhesion surface to the flat spring 64*b* of the blade back side seal 117, the opposite face is contacted by the upper portion side seal 107 in a pressed state as shown in FIG. 10. Since the blade back side seal 117 is formed from urethane sponge, the contacting portion between the blade back side seal 117 and the upper portion side seal 107 is formed by contact between sponge materials. Further, the lower end surface of the end portion region of the blade back side seal 117 contacts with the side edge seal 106 as shown in FIG. 10. Thus, the contacting portion between the end portion region of the blade back side seal 117 and the side edge seal 106 is formed also by contact between sponge materials. As such, the boundaries of the blade back side seal 117 with other members are all formed by contact between sponge materials, except for the adhesion surface with the flat spring 64*b*. This reliably avoids toner leakage.

Further, as shown in FIG. 1, inside of the development chamber 57 in the case 51, a rib 51*b* is provided behind the layer thickness control blade 64. When the layer thickness control blade 64 is attached to the case 51, the blade back side seal 117 contacts with the rib 51*b* in a pressed state. This avoids entrance of toner into the back side of the layer thickness control blade 64, deposition of non-charged toner in the back side of the layer thickness control blade 64, and the like. This avoids fogging that occurs when the non-charged toner falls from the back side of the layer thickness control blade 64.

FIG. 18 is an enlarged sectional view showing the seal portion in the state of FIG. 9A viewed from an arrow C direction. However, the supporting member 64*c* and the like are omitted for the simplicity of description. As shown in this FIG. 18, the blade back side seal 117 has: a layer thickness control member opposing face 117*a* attached to the supporting member 64*c* of the layer thickness control blade 64 with a double-sided tape; a housing opposing face 117*b* opposing this layer thickness control member opposing face 117*a*; and side faces 117*c* each of which connects to each other the layer thickness control member opposing face 117*a* and the housing opposing face 117*b* in the opposite relation. Then, a side face 117*c*that faces the cut-out portion 120 among the side faces 117*c* of the blade back side seal 117 is formed such as to be inclined toward an end portion in the longitudinal direction of the layer thickness control blade 64 directing from the layer thickness control member opposing face 117*a* to the housing opposing face 117*b*. This side face is referred to as the inclined side face 117*c*', hereinafter. On the other hand, when the inclined side face 117*c*' of the blade back side seal 117 is formed in the opposite manner, that is, such as to be inclined inward in the longitudinal direction of the layer thickness control blade 64, the blade back side seal 117 is compressed such that the inclined side face 117*c*' should block a part of the cut-out portion 120, when pressed from the X-direction by the attached layer thickness control blade 64. As a result, the toner stagnating at the end portion of the developing roller 59 cannot return to the development chamber 57 so that the toner stagnates in the vicinity of the cut-out portion 120. This causes toner leakage. In contrast, according to the present embodiment in which the inclined side face 117*c*' of the blade back side seal 117 that faces the cut-out portion 120 is formed such as to be inclined toward an end portion in the longitudinal direction of the layer thickness control blade 64 directing from the layer thickness control member opposing face 117*a* to the housing opposing face 117*b*, the above-mentioned problem does not arise. Thus, according to the present embodiment, toner leakage from the opening of the case 51 is avoided reliably.

As shown in FIG. 18, in the vicinity of the cut-out portion 120 of the blade back side seal 117, when the cross section formed by a plane that passes through the layer thickness control member opposing face 117*a*, the housing opposing face 117*b*, the incline side face 117*c*', and the side face 117*c* opposing the inclined side face 117*c*' and that is orthogonal to the layer thickness control member opposing face 117*a* is formed into a parallelogram, the blade back side seal 117 is compressed stably and uniformly in the same direction even when the blade back side seal 117 is pressed from the above by the layer thickness control blade 64. Obviously, the employable shape is not limited to this. That is, the cross section of the blade back side seal 117 may be formed into a polygon other than a rectangle.

Here, obviously, in place of the configuration that the blade back side seal 117 is attached to the supporting member 64*c* of the layer thickness control blade 64, the blade back side seal 117 may be attached to the portion of the case 51 to which the layer thickness control blade 64 is attached.

On the other hand, on the front face side of the flat spring 64*b* where the pressing member 64*a* is provided, as shown in FIG. 9B, a front side blade side seal 112 is attached with a double-sided tape such as to contact with both end portions of the pressing member 64*a*. The front side blade side seal 112 is formed from urethane sponge. On the front side blade side seal 112, later-described felt is attached. However, as shown in FIG. 12D, the total thickness of the thickness of the front side blade side seal 112 and the thickness of the felt is set up thicker than the pressing member 64*a* with considering a certain amount of compression. When the thickness of the front side blade side seal 112 and the felt is set up as described here, the pressing force acting from the pressing member 64*a* on both end portion sides onto the developing roller 59 does not vary even when the pressing member 64*a* is worn out. This reliably avoids toner leakage from the pressure contact portion between the pressing member 64*a* and the developing roller 59.

Figure 11A:
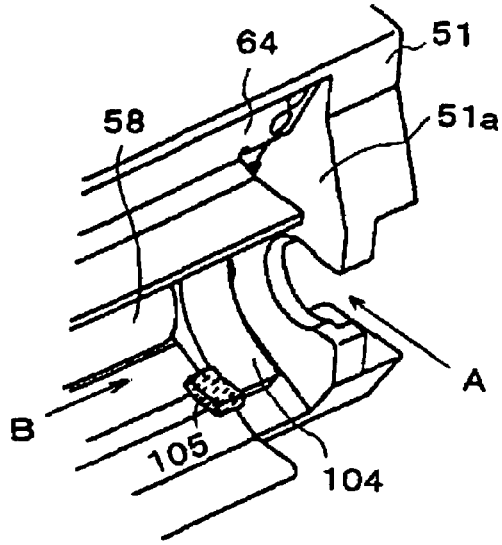
FIG. 11A is a partly sectional perspective view showing a seal portion of a developing apparatus case in a case that a lower side seal is attached.
Figure 11B:
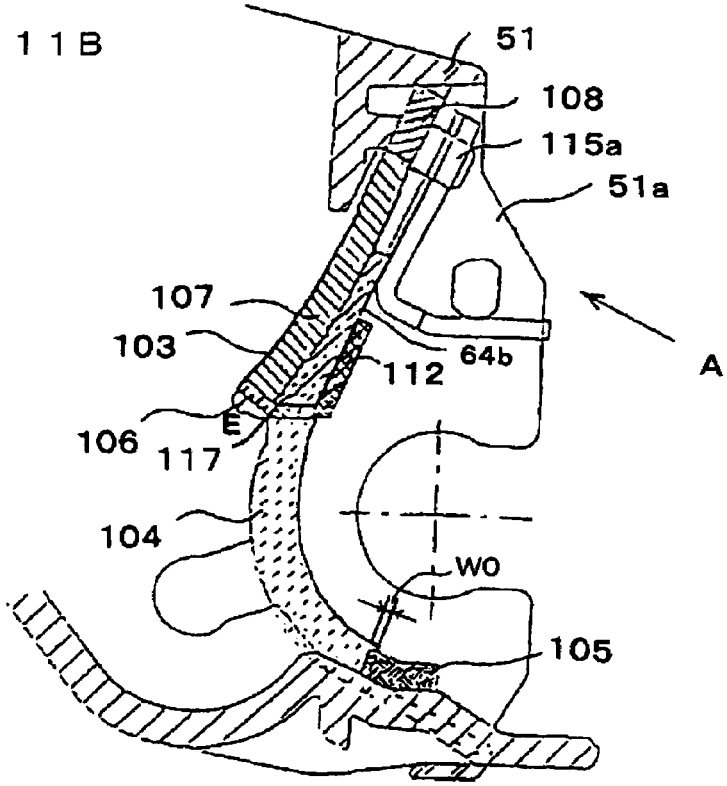
FIG. 11B is a vertical sectional view showing the seal portion in the state of FIG. 11A viewed from an arrow B direction.

Next, as shown in FIG. 11A and FIG. 11B, in order to avoid toner leakage from the boundary between the lower portion seal attaching region 101 and the side seal attaching region 100 and toner leakage from the gap between the movable portion of the lower film described later and the lower portion seal attaching region 101, a lower side seal 105 is attached to an end portion of the lower portion seal attaching region 101 with a double-sided tape. The lower side seal 105 is formed from urethane sponge. The double-sided tape is adhered onto the bottom face of the lower side seal 105. The end face of the side seal 104 side is attached such as to overlaps in a portion of region W0 as shown in FIG. 11B. As a result, the lower side seal 105 is pressed and thereby contacts closely with the side seal 104. In the present embodiment, the region W0 is set to be approximately 2 mm.

Figure 12A:
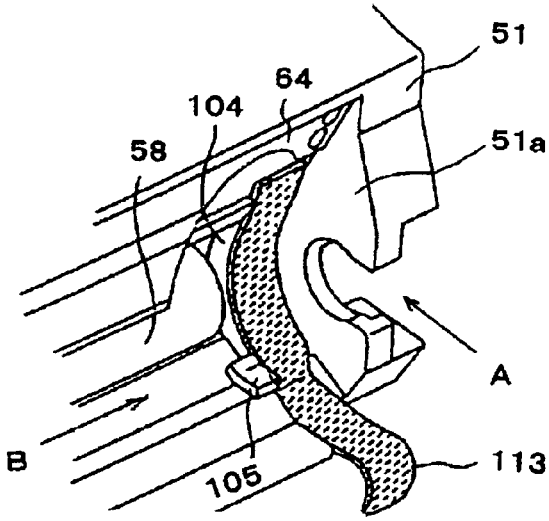
FIG. 12A is a-partly sectional perspective view showing a seal portion of a developing apparatus case in a case that felt is attached.
Figure 12C:
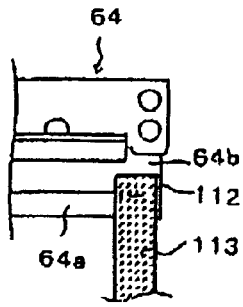
FIG. 12C is an elevation view showing the seal portion in the state of FIG. 12A viewed from an arrow A direction.
Figure 12B:
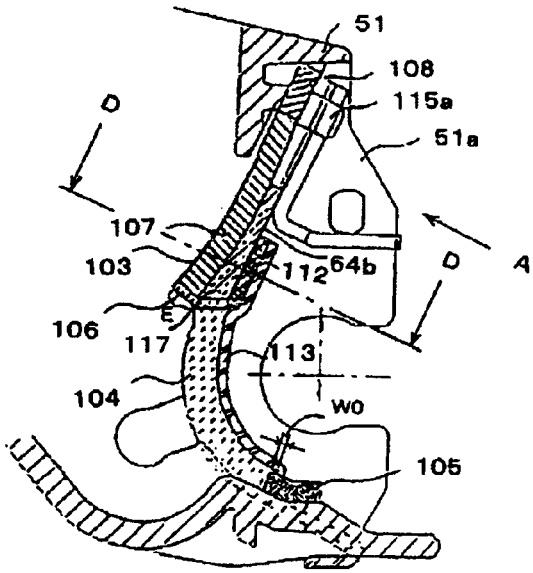
FIG. 12B is a vertical sectional view showing the seal portion in the state of FIG. 12A viewed from an arrow B direction.
Figure 12D:
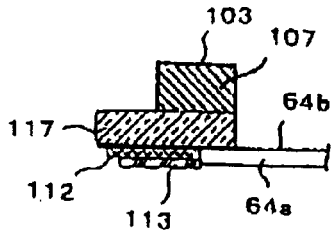
FIG. 12D is a sectional view taken along line D-D in FIG. 12C.

Next, as shown in FIG. 12A, FIG. 12B and FIG. 12C, felt 113 of fluorine family serving as a sliding portion is attached with a double-sided tape over a region extending from the flat spring 64*b* of the layer thickness control blade 64, through the front side blade side seal 112, to the side seal attaching region 100. On the layer thickness control blade 64, a tip portion of the felt 113 is adhered on the flat spring 64*b* as shown in FIG. 12B and FIG. 12C, and a portion connected thereto is adhered such as to cover the front side blade side seal 112. This configuration reliably avoids toner leakage from both end portions of the pressing member 64*a* of the layer thickness control blade 64.

Further, in the present embodiment, as shown in FIG. 12B, FIG. 12C and FIG. 12D, the felt 113 is configured so as to located at a position of each end surface side of the pressing member 64*a* and goes over the position of the flat spring 64*b*. This prevents the fibers of the felt from entering into the pressure contact portion between the pressing member 64*a* and the developing roller 59. Thus, no gap is formed between the pressing member 64*a* and the developing roller 59. This reliably avoids toner leakage from a gap between the pressing member 64*a* and the developing rollers 59. Further, since the felt 113 is configured so as to go over the flat spring 64*b* as described above, the felt 113 moves together in response to the motion of the flat spring 64*b* of the layer thickness control blade 64. This avoids the blocking of the motion of the flat spring 64*b* of the layer thickness control blade 64. Further, in the present embodiment, as shown in FIG. 12B and FIG. 12D, in the portion where the felt 113 goes over, a front side blade side seal 112 which is a foaming elastic body layer formed from a sponge material different from the side seal 104 which is the first leakage preventing member is provided between the flat spring 64*b* and the felt 113, and adhered to the flat spring 64*b* and the felt 113 with a double-sided tape. As a result, even when the felt 113 is pressed by a sufficient pressing force from the developing roller 59 in order to reliably avoid toner leakage from both end portions of the developing roller 59, the repulsive force in this portion is absorbed the front side blade side seal 112 having an appropriate amount of compression. Thus, the pressing force against the developing roller 59 by the pressing member 64*a* of the layer thickness control blade 64 does not become weak at both end portions of the developing roller 59.

Figure 15:
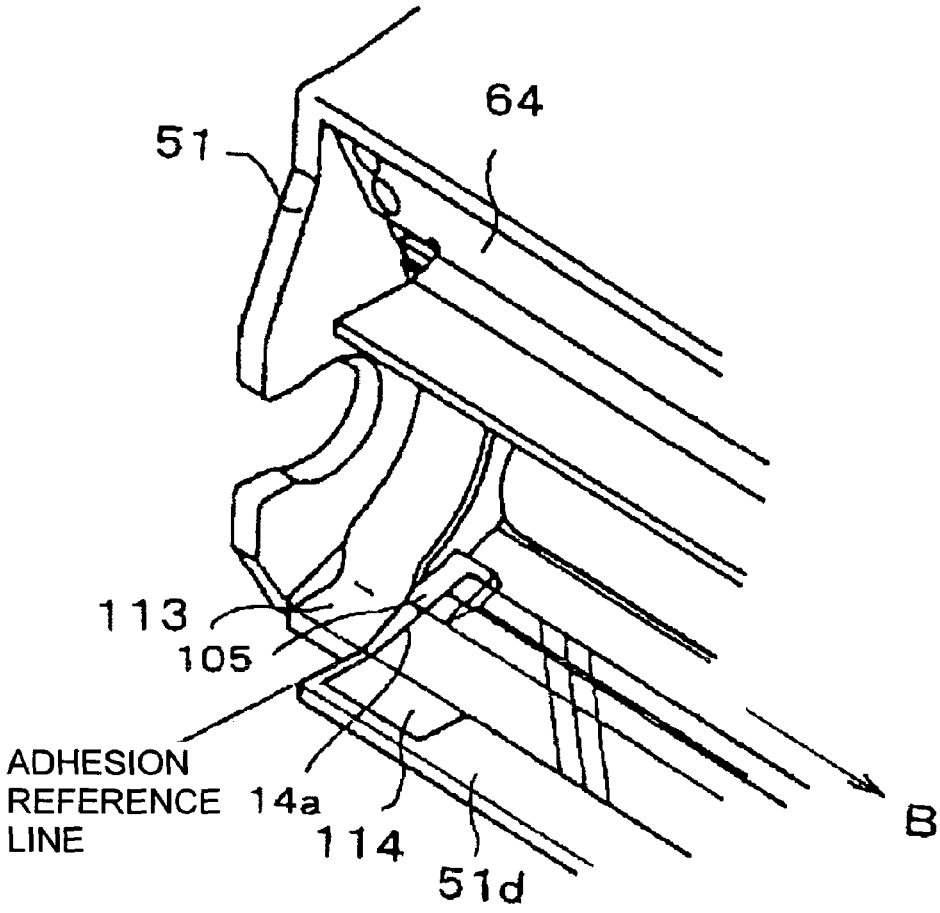
FIG. 15 is a partly sectional perspective view showing a seal portion of a case 51 opposite to that of FIG. 12A in a case that a lower film is attached.

Next, as shown in FIG. 14 and FIG. 15, a lower film 114 which is a bottom end portion developing agent leakage preventing member is attached. The lower film 114 is constructed from a PET sheet or a urethane rubber film. In the present embodiment, a PET sheet is employed. The lower film 114 is adhered with a double-sided tape to a part of the lower portion seal attaching region 101, a part of the front edge portion 51*d* of the case 51, and a part of the lower side seal 105. As such, since the adhesion surface of the lower film 114 includes not only the lower portion seal attaching region 101 but also the region of the front edge portion 51*d*, the lower film 114 becomes difficult to be separated. Thus, even when the pressing force between the developing roller 59 and the lower film 114 or the felt 113 becomes high to an extent, the lower film 114 is reliably prevented from being separated. Further, both end portions 114*a* of the lower film 114 are formed oblique relative to the adhesion reference line as shown in FIG. 14 and FIG. 15. As a result, a gap is formed between each end portion 114*a* of the lower film 114 and the felt 113 so that the lower side seal 105 is exposed from this gap. Thus, the lower film 114 does not go over the felt 113, and hence a gap is not generated that would be formed by a step between the developing roller 59 and the felt 113. This reliably avoids toner leakage from the contacting portion between the felt 113 and the lower film 114.

Figure 13:
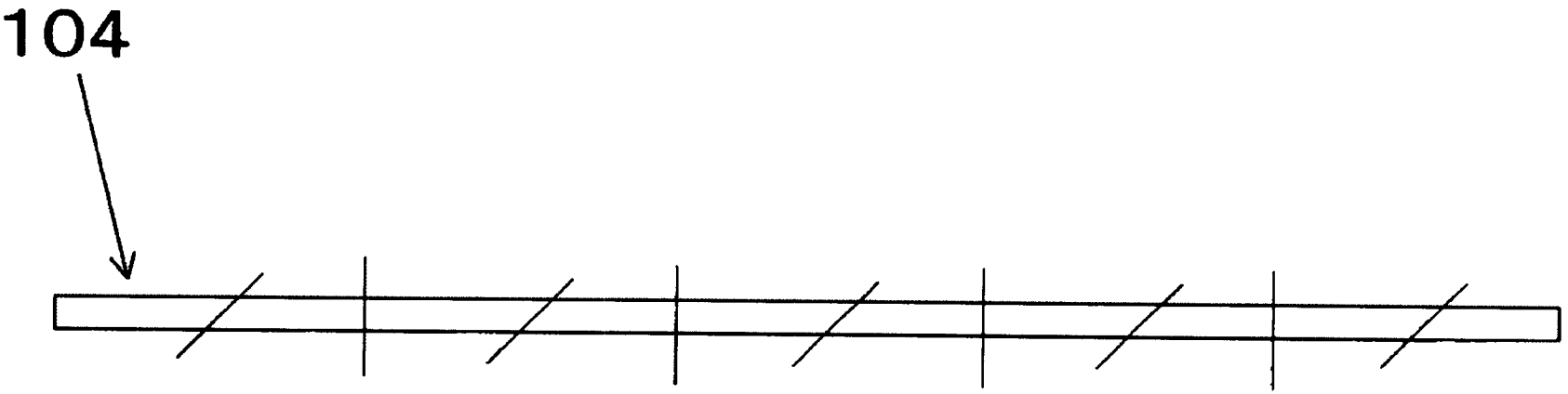
FIG. 13 is a diagram describing a method of forming a side seal.

Here, the inclined side face 104*c*' of the side seal 104 described in the present embodiment can be formed by cutting obliquely a urethane sponge sheet of a predetermined thickness as shown in FIG. 13. Further, the side face 104*c* to which a double-sided tape 130 to the side face portion 51*a* of a developing roller accommodating portion of the case 51 is attached may be cut at right angles as in the prior art. FIG. 13 has been described for the case of the side seal 104. However, the inclined side face of the upper seal 108 or the blade back side seal 117 may similarly be formed by cutting obliquely a urethane sponge sheet.

As described above, in the developing apparatus 50 according to the present embodiment, toner leakage from the upper portion, both end portions, and the lower portion of the developing roller 59 can be avoided reliably.

In particular, in the present embodiment, the side seal 104 for avoiding toner leakage from the end portions of the developing roller 59, the blade back side seal 117 attached to the layer thickness control blade 64 for avoiding toner leakage from a gap between the developing roller 59 and the openings of the case 51, and the upper seal 108 attached to the case 51 are provided with an inclined side face formed such as to be inclined in a predetermined direction always even when pressed from the above. Thus, when the attaching method and the attaching position of these sealing members are adjusted, toner leakage can be avoided reliably.

More specifically, according to the developing apparatus of the present invention, at least one of the side faces is an inclined side face formed such as to be inclined in a predetermined direction relative to the housing attaching face when the first leakage preventing member is pressed from the front face side. Thus, the direction is determined in which the first leakage preventing member is compressed when pressed from the above. Thus, the first leakage preventing member can always be compressed in a direction not causing toner leakage.

Further, according to the developing apparatus of the present invention, the cross section formed by a plane that passes through the four side faces consisting of the housing attaching face, the front face, the inclined side face, and the side face opposing the inclined side face and that is orthogonal to the housing attaching face is a trapezoid or a parallelogram. Thus, in the case that the angle formed between the housing attaching face and the inclined side face when the first leakage preventing member is pressed from the above is less than 90°, the inclined side face is compressed toward the housing attaching face. On the contrary, in the case that the angle is larger than 90°, the inclined side face is compressed in a direction departing from the housing attaching face. As such, since the direction of falling down of the compressed inclined side face is determined reliably, the first leakage preventing member can always be compressed in a direction not causing toner leakage.

Further, according to the developing apparatus of the present invention, the side face opposing the inclined side face of the first leakage preventing member is attached to the developer housing with a double-sided adhesion member. Thus when the first leakage preventing member is compressed by pressing, the compression deformation of this side face can be suppressed.

Further, according to an embodiment of the developing apparatus of the present invention, a double-sided tape is employed as the double-sided adhesion member. Thus, the side face opposing the inclined side face of the first leakage preventing member can be attached to the developer housing at low cost and in a simple configuration.

Further, according to the developing apparatus of the present invention, the direction in which the first leakage preventing member is compressed is determined. Thus, the attaching method and the attaching position can be adjusted so that toner leakage from both end portions in the longitudinal directions of the opening of the developer housing can be avoided reliably.

Further, according to the developing apparatus of the present invention, the first leakage preventing member is always compressed at both end portions in the longitudinal directions of the opening of the developer housing in such a manner that the inclined side face should be inclined toward an end portion in the longitudinal direction directing from the housing attaching face to the front face. Thus, at both end portions in the longitudinal directions, the first leakage preventing member can always be compressed in a direction not causing toner leakage.

Further, according to the developing apparatus of the present invention, when the second leakage preventing member is pressed and compressed by the layer thickness control member, the inclined side face is compressed and inclined in the longitudinal direction of the layer thickness control member, toward an end portion in the longitudinal direction directing from the layer thickness control member opposing face to the housing opposing face. Thus, between the developer housing and the layer thickness control member, the second leakage preventing member can always be compressed in a direction not causing toner leakage.

Further, according to the developing apparatus of the present invention, a polymerization toner fabricated by a polymerization method has been employed as the developing agent. Thus, high fluidity is obtained so that high definition development is achieved. Further, this polymerization toner easily results in toner leakage because of the high fluidity. However, since the inclined side face is provided that falls down always in a fixed direction when the first and second leakage preventing members are compressed by pressing, the first and second leakage preventing members can always be compressed in a direction not causing toner leakage.

Further, according to the process cartridge of the present invention, the developing apparatus according to the present invention described above is applied to a process cartridge formed in a manner attachable to and detachable from an image forming apparatus. Thus, toner leakage can be avoided reliably also at the time of attachment and detachment of the process cartridge.

Further, according to the developer cartridge of the present invention, the developing apparatus according to the present invention described above is formed in a manner attachable to and detachable from an image forming apparatus or a process cartridge. Thus, toner leakage can be avoided reliably also at the time of attachment and detachment of the developer cartridge.

Further, according to the image forming apparatus of the present invention, the developing apparatus of the present invention described above (or alternatively the process cartridge of the present invention or the developer cartridge of the present invention) is employed so that toner leakage does not occur. This avoids pollution with the developing agent in the image forming apparatus body.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds there-of are therefore intended to be embraced by the claims.

What is claimed is:

1. A developing apparatus comprising:

a developer housing having an opening and accommodating a developing agent;

a developing agent carrying body arranged in said opening of said developer housing rotatably in such a manner that a rotation axis is parallel to a longitudinal direction of said opening, and that develops an electrostatic latent image into a visible image by making a layer of the developing agent formed thereon oppose an electrostatic latent image; and a leakage preventing member, for preventing developing agent from leaking from both side portions of said developing agent carrying body, attached to said developer housing, and having:

a housing attaching face that contacts with said developer housing;

a front side face that opposes said housing attaching face; and side faces each of which connects to each other end portions of said housing attaching face and said front side face in the longitudinal directions of said opening of said developer housing;

wherein at least one of said side faces is an inclined side face that is inclined from the housing attaching face to the front side face, wherein the width of the leakage prevention member decreases along the inclined side face from the housing attaching face to the front side face.

2. The developing apparatus as set forth in claim 1, wherein a cross section of said leakage preventing member is formed by a plane that passes through said housing attaching face, said front side face, said inclined side face, and a side face opposing said inclined side face and that is orthogonal to said housing attaching face, the cross section being a trapezoid or a parallelogram.

3. The developing apparatus as set forth in claim 2, wherein said leakage preventing member is attached to both end portions in said longitudinal directions of said opening of said developer housing.

4. The developing apparatus as set forth in claim 3, wherein said leakage preventing member is formed at both end portions of said opening of said developer housing in such a manner that said inclined side face is inclined toward an end portion in said longitudinal direction of said opening directing from said housing attaching face to said front side face.

5. The developing apparatus as set forth in claim 4, wherein said developing agent is a polymerization toner fabricated by a polymerization method.

6. A developing apparatus comprising:

a developer housing having an opening and accommodating a developing agent;

a developing agent carrying body arranged in said opening of said developer housing rotatably in such a manner that a rotation axis is parallel to a longitudinal direction of said opening, and that develops an electrostatic latent image into a visible image by making a layer of the developing agent formed thereon oppose an electrostatic latent image;

a rectangular layer thickness control member for controlling a layer thickness of the developing agent carried on said developing agent carrying body into a predetermined layer thickness; and a leakage preventing member, for preventing developing agent from leaking between said developer housing and said layer thickness control member, attached between said developer housing and a back side of said layer thickness control member, and extending to both ends of the layer thickness control member along the longitudinal direction of said opening, and having:

a layer thickness control member opposing face that contacts with said layer thickness control member;

a housing opposing face that is opposite to said layer thickness control member opposing face; and side faces each of which connects to each other end portions of said layer thickness control member opposing face and said housing opposing face in the longitudinal directions of said opening;

wherein at least one of said side faces is an inclined side face that is inclined from the layer thickness control member opposing face to the housing opposing face, wherein the width of the leakage prevention member decreases along the inclined side face from the housing opposing face to the layer thickness control member opposing face.

7. The developing apparatus as set forth in claim 6, wherein said developing agent is a polymerization toner fabricated by a polymerization method.

8. A process cartridge attachable to and detachable from an image forming apparatus, including:

a latent image carrying body on which an electrostatic latent image is formed; and a developing apparatus comprising:

a developer housing having an opening and accommodating a developing agent;

a developing agent carrying body arranged in said opening of said developer housing rotatably in such a manner that a rotation axis is parallel to a longitudinal direction of said opening, and that develops an electrostatic latent image formed on said latent image carrying body into a visible image by making a layer of the developing agent formed thereon oppose an electrostatic latent image; and a leakage preventing member, for preventing developing agent from leaking from both side portions of said developing agent carrying body, attached to said developer housing, and having:

a housing attaching face that contacts with said developer housing;

a front side face that opposes said housing attaching face; and side faces each of which connects to each other end portions of said housing attaching face and said front side face in the longitudinal directions of said opening of said developer housing;

wherein at least one of said side faces is an inclined side face that is inclined from the housing attaching face to the front side face, wherein the width of the leakage prevention member decreases along the inclined side face from the housing attaching face to the front side face.

9. The process cartridge as set forth in claim 8, wherein a cross section of said leakage preventing member is formed by a plane that passes through said housing attaching face, said front side face, said inclined side face, and a side face opposing said inclined side face and that is orthogonal to said housing attaching face, the cross section being a trapezoid or a parallelogram.

10. The process cartridge as set forth in claim 9, wherein said leakage preventing member is attached to both end portions in said longitudinal directions of said opening of said developer housing.

11. The process cartridge as set forth in claim 10, wherein said leakage preventing member is formed at both end portions of said opening of said developer housing in such a manner that said inclined side face is inclined toward an end portion in said longitudinal direction of said opening directing from said housing attaching face to said front side face.

12. The process cartridge as set forth in claim 11, wherein said developing agent is a polymerization toner fabricated by a polymerization method.

13. A process cartridge attachable to and detachable from an image forming apparatus, including:

a latent image carrying body on which an electrostatic latent image is formed; and a developing apparatus comprising:

a developer housing having an opening and accommodating a developing agent;

a developing agent carrying body arranged in said opening of said developer housing rotatably in such a manner that a rotation axis is parallel to a longitudinal direction of said opening, and that develops an electrostatic latent image formed on said latent image carrying body into a visible image by making a layer of the developing agent formed thereon oppose an electrostatic latent image;

a rectangular layer thickness control member for controlling a layer thickness of the developing agent carried on said developing agent carrying body into a predetermined layer thickness; and a leakage preventing member, for preventing developing agent from leaking between said developer housing and said layer thickness control member, attached between said developer housing and a back side of said layer thickness control member, and extending to both ends of the layer thickness control member along the longitudinal direction of said opening, and having:

a layer thickness control member opposing face that contacts with said layer thickness control member;

a housing opposing face that is opposite to said layer thickness control member opposing face; and side faces each of which connects to each other end portions of said layer thickness control member opposing face and said housing opposing face in the longitudinal directions of said opening;

wherein at least one of said side faces is an inclined side face that is inclined from the layer thickness control member opposing face to the housing opposing face, wherein the width of the leakage prevention member decreases along the inclined side face from the housing opposing face to the layer thickness control member opposing face.

14. The process cartridge as set forth in claim 13, wherein said developing agent is a polymerization toner fabricated by a polymerization method.

15. A developer cartridge including a developing apparatus attachable to and detachable from an image forming apparatus or a process cartridge, said developing apparatus comprising:

a developer housing having an opening and accommodating a developing agent;

a developing agent carrying body arranged in said opening of said developer housing rotatably in such a manner that a rotation axis is parallel to a longitudinal direction of said opening, and that develops an electrostatic latent image into a visible image by making a layer of the developing agent formed thereon oppose an electrostatic latent image; and a leakage preventing member, for preventing developing agent from leaking from both side portions of said developing agent carrying body, attached to said developer housing, and having:

a housing attaching face that contacts with said developer housing;

a front side face that opposes said housing attaching face; and side faces each of which connects to each other end portions of said housing attaching face and said front side face in the longitudinal directions of said opening of said developer housing;

wherein at least one of said side faces is an inclined side face that is inclined from the housing attaching face to the front side face, wherein the width of the leakage prevention member decreases along the inclined side face from the housing attaching face to the front side face.

16. The developer cartridge as set forth in claim 15, wherein a cross section of said leakage preventing member is formed by a plane that passes through said housing attaching face, said front side face, said inclined side face, and a side face opposing said inclined side face and that is orthogonal to said housing attaching face, the cross section being a trapezoid or a parallelogram.

17. The developer cartridge as set forth in claim 16, wherein said leakage preventing member is attached to both end portions in said longitudinal directions of said opening of said developer housing.

18. The developer cartridge as set forth in claim 17, wherein said leakage preventing member is formed at both end portions of said opening of said developer housing in such a manner that said inclined side face is inclined toward an end portion in said longitudinal direction of said opening directing from said housing attaching face to said front side face.

19. The developer cartridge as set forth in claim 18, wherein said developing agent is a polymerization toner fabricated by a polymerization method.

20. A developer cartridge including a developing apparatus attachable to and detachable from an image forming apparatus or a process cartridge, said developing apparatus comprising:

a developer housing having an opening and accommodating a developing agent;

a developing agent carrying body arranged in said opening of said developer housing rotatably in such a manner that a rotation axis is parallel to a longitudinal direction of said opening, and that develops an electrostatic latent image into a visible image by making a layer of the developing agent formed thereon oppose an electrostatic latent image;

a rectangular layer thickness control member for controlling a layer thickness of the developing agent carried on said developing agent carrying body into a predetermined layer thickness; and a leakage preventing member, for preventing developing agent from leaking between said developer housing and said layer thickness control member, attached between said developer housing and a back side of said layer thickness control member, and extending to both ends of the layer thickness control member along the longitudinal direction of said opening, and having:

a layer thickness control member opposing face that contacts with said layer thickness control member;

a housing opposing face that is opposite to said layer thickness control member opposing face; and side faces each of which connects to each other end portions of said layer thickness control member opposing face and said housing opposing face in the longitudinal directions of said opening;

wherein at least one of said side faces is an inclined side face that is inclined from the layer thickness control member opposing face to the housing opposing face, wherein the width of the leakage prevention member decreases along the inclined side face from the housing opposing face to the layer thickness control member opposing face.

21. The developer cartridge as set forth in claim 20, wherein said developing agent is a polymerization toner fabricated by a polymerization method.

22. An image forming apparatus including a developing apparatus, said developing apparatus comprising:

a developer housing having an opening and accommodating a developing agent;

a developing agent carrying body arranged in said opening of said developer housing rotatably in such a manner that a rotation axis is parallel to a longitudinal direction of said opening, and that develops an electrostatic latent image into a visible image by making a layer of the developing agent formed thereon oppose an electrostatic latent image; and a leakage preventing member, for preventing developing agent from leaking from both side portions of said developing agent carrying body, attached to said developer housing, and having:

a housing attaching face that contacts with said developer housing;

a front side face that opposes said housing attaching face; and side faces each of which connects to each other end portions of said housing attaching face and said front side face in the longitudinal directions of said opening of said developer housing;

wherein at least one of said side faces is an inclined side face that is inclined from the housing attaching face to the front side face, wherein the width of the leakage prevention member decreases along the inclined side face from the housing attaching face to the front side face.

23. The image forming apparatus as set forth in claim 22, wherein a cross section of said leakage preventing member is formed by a plane that passes through said housing attaching face, said front side face, said inclined side face, and a side face opposing said inclined side face and that is orthogonal to said housing attaching face, the cross section being a trapezoid or a parallelogram.

24. The image forming apparatus as set forth in claim 23, wherein said leakage preventing member is attached to both end portions in said longitudinal directions of said opening of said developer housing.

25. The image forming apparatus as set forth in claim 24, wherein said leakage preventing member is formed at both end portions of said opening of said developer housing in such a manner that said inclined side face is inclined toward an end portion in said longitudinal direction of said opening directing from said housing attaching face to said front side face.

26. The image forming apparatus as set forth in claim 25, wherein said developing agent is a polymerization toner fabricated by a polymerization method.

27. An image forming apparatus including a developing apparatus, said developing apparatus comprising:

a developer housing having an opening and accommodating a developing agent;

a developing agent carrying body arranged in said opening of said developer housing rotatably in such a manner that a rotation axis is parallel to a longitudinal direction of said opening, and that develops an electrostatic latent image into a visible image by making a layer of the developing agent formed thereon oppose an electrostatic latent image;

a rectangular layer thickness control member for controlling a layer thickness of the developing agent carried on said developing agent carrying body into a predetermined layer thickness; and a leakage preventing member, for preventing developing agent from leaking between said developer housing and said layer thickness control member, attached between said developer housing and a back side of said layer thickness control member, and extending to both ends of the layer thickness control member along the longitudinal direction of said opening, and having:

a layer thickness control member opposing face that contacts with said layer thickness control member;

a housing opposing face that is opposite to said layer thickness control member opposing face; and side faces each of which connects to each other end portions of said layer thickness control member opposing face and said housing opposing face in the longitudinal directions of said opening;

wherein at least one of said side faces is an inclined side face that is inclined from the layer thickness control member opposing face to the housing opposing face, wherein the width of the leakage prevention member decreases along the inclined side face from the housing opposing face to the layer thickness control member opposing face.

28. The image forming apparatus as set forth in claim 27, wherein said developing agent is a polymerization toner fabricated by a polymerization method.

* * * * *